US010994428B2

(12) United States Patent
Gallegos et al.

(10) Patent No.: US 10,994,428 B2
(45) **Date of Patent: *May 4, 2021**

(54) RETRACTABLE UTILITY KNIFE

(71) Applicant: Slice, Inc., San Jose, CA (US)

(72) Inventors: Robert Joseph Gallegos, Fremont, CA (US); Thomas John Scimone, Campbell, CA (US); Scot Herbst, Santa Cruz, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/188,108

(22) Filed: Nov. 12, 2018

(65) Prior Publication Data

US 2019/0077031 A1 Mar. 14, 2019

Related U.S. Application Data

(63) Continuation of application No. 15/043,535, filed on Feb. 13, 2016, now Pat. No. 10,124,495, which is a continuation-in-part of application No. 14/106,678, filed on Dec. 13, 2013, now Pat. No. 9,579,808, which is a continuation-in-part of application No. 14/101,729, filed on Dec. 10, 2013, now Pat. No. 9,364,958.

(60) Provisional application No. 61/739,712, filed on Dec. 19, 2012, provisional application No. 61/739,710, filed on Dec. 19, 2012.

(51) Int. Cl.
*B26B 1/08* (2006.01)
*B26B 5/00* (2006.01)

(52) U.S. Cl.
CPC ..... *B26B 1/08* (2013.01); *B26B 5/001* (2013.01); *B26B 5/003* (2013.01)

(58) Field of Classification Search
CPC ..... B26B 1/08; B26B 5/003; B26B 5/001
USPC ... 30/62, 286, 123, 124, 125, 335, 340, 342, 30/151, 293, 344; 222/80, 191, 192; 606/166–172, 181; 7/158, 160; 401/185, 401/195
See application file for complete search history.

(56) References Cited

U.S. PATENT DOCUMENTS 6,623,499 B1 * 9/2003 Andreini ..... A61B 17/3211 30/329
7,575,583 B1 * 8/2009 Schraga ..... A61B 5/1411 606/161
2014/0165409 A1 * 6/2014 Scimone ..... B26B 5/003 30/162

* cited by examiner

*Primary Examiner* — Ghassem Alie
(74) *Attorney, Agent, or Firm* — Ellenoff Grossman & Schole LLP; James M. Smedley; Alex Korona

(57) ABSTRACT

A utility knife configured with a retractable cutting blade that is extended and retracted by a blade actuation mechanism. The blade actuation mechanism includes a slider button assembly and a blade carriage assembly that are operably connected in variety of configurations, including a configuration with a rack-and-pinion arrangement between the slider button assembly and the blade carriage assembly. The rack-and-pinion blade actuation mechanism is configured to automatically retract the cutting blade as the cutting blade is lifted from the cutting surface.

13 Claims, 10 Drawing Sheets

RETRACTABLE UTILITY KNIFE

CROSS-REFERENCE TO RELATED APPLICATIONS

This application is a continuation of U.S. Non-Provisional Utility patent application Ser. No. 15/043,535, filed Feb. 13, 2016, and entitled "Retractable Utility Knife" which is a continuation-in-part of both U.S. Non-Provisional Utility patent application Ser. No. 14/101,729, filed Dec. 10, 2013, and entitled "Pen Cutter", which claims the benefit of U.S. Provisional Patent Application No. 61/739,710 filed on Dec. 19, 2012 and entitled "Pen Cutter", and U.S. Non-Provisional Utility patent application Ser. No. 14/106,678, filed Dec. 13, 2013, and entitled "Pocket Cutter", which claims the benefit of U.S. Provisional Patent Application No. 61/739,712 filed on Dec. 19, 2012 and entitled "Pocket Cutter", the entire disclosures of each and all of the above mentioned references are hereby incorporated herein by reference.

FIELD OF THE INVENTION

The present invention generally relates to a utility knife with a retractable cutting blade. Specifically, embodiments of the present invention relate to a utility knife apparatus with a self-retracting cutting blade, including embodiments where the cutting blade is automatically retracted when the cutting blade is lifted from the cutting surface.

BACKGROUND

Utility knifes may be designed in a variety of configurations and include any number of features to improve the safety and ergonomics of the tool. One feature of a utility knife is a cutting blade that can be retracted into the body of the utility knife to improve safety. However, the cutting blade of currently available utility knives is not retracted until a user releases or retracts the button or other actuator that is used to extend the cutting blade. This creates a safety hazard, as the cutting blade remains extended even after the cutting blade is lifted from the cutting surface. Furthermore, the design of traditional utility knifes is such that the cutting blade is only extended when a button or other actuator is pushed toward the end of the utility knife from which cutting blade extends. However, such a design is not ideal from an ergonomic perspective as it requires a user to stretch their thumb or finger to extend the cutting blade out of the body of the utility knife. Given the fact that utility knifes use a pulling motion to make a cut, this requires a user to extend and hold their thumb or finger in one direction while pulling their hand in the opposite direction, thereby creating a situation where the blade extending motion is in the opposite direction of the cutting motion. This motion can cause excessive fatigue and stress on hand and fingers, which may weaken grip and lead to unsafe use of the utility knife.

Therefore, there is a need in the art for a utility knife that is configured to both automatically retract the cutting blade when the cutting blade is lifted from the cutting surface and extend the cutting blade when a button or other actuator is pulled toward the opposite end of the utility knife from which the cutting blade extends, thereby allowing the blade extending motion and cutting motion to be in the same direction. These and other features and advantages of the present invention will be explained and will become obvious to one skilled in the art through the summary of the invention that follows.

SUMMARY OF THE INVENTION

Accordingly, it is an aspect of the present invention to provide a utility knife with a blade actuation mechanism that extends a cutting blade when button or other actuation is moved toward the opposite end of the utility knife from which the cutting blade extends. Furthermore, it is an aspect of the present invention to provide a blade actuation mechanism wherein moving the slider button assembly in one direction causes the blade carriage assembly to move in the opposite direction.

According to an embodiment of the present invention, an automatically retracting utility knife, comprising: a blade actuation mechanism comprising a pinion gear, a slider button assembly and a blade carriage assembly that are operably connected in a rack-and-pinion arrangement, wherein the slider button assembly comprises a slider rack and the blade carriage assembly comprises a blade carriage that slide in opposite directions to move the blade carriage, and therefore a cutting blade, between a retracted position and an extended position; a tension component attached to the blade carriage to bias the blade carriage, and therefore the cutting blade, to the retracted position; and a housing shell defining an interior cavity configured to retain the blade actuation mechanism and the tension component, the housing shell comprising a front edge formed with a blade outlet slot, a rear edge opposite the front edge, a front-half portion, and a rear-half portion.

According to an embodiment of the present invention, the slider button assembly further comprises a slider button, a slider pin retained on the slider button that facilitates a reversible connection between the slider button and the slider rack, and a second tension component attached to the slider button to bias the slider button toward the front edge of the housing shell.

According to an embodiment of the present invention, dragging the cutting blade along a cutting surface pulls the blade carriage toward the front edge of the housing shell, thereby causing the slider rack to move toward the rear edge of the housing shell, which disengages the slider pin from a lever arm formed on the slider rack and therefore disconnects the slider button and the slider rack, enabling the tension component to automatically return the blade carriage, and therefore the cutting blade, to the retracted position when the cutting blade is lifted from the cutting surface and regardless of whether the slider button has been released.

According to an embodiment of the present invention, the second tension component is configured to pull the slider button toward the front edge of the housing shell to reengage the slider pin with the lever arm of the slider rack when the slider button is released.

According to an embodiment of the present invention, the blade carriage assembly further comprises a blade holder cover and a blade retention pin and the blade carriage further comprises a blade holder configured to receive the cutting blade in two orientations.

According to an embodiment of the present invention, the front side of the blade holder is formed with a depression defined by a rim that borders all but an open side of the depression and is configured to receive the cutting blade.

According to an embodiment of the present invention, the blade holder comprises a blade orientation indicator and a retention pin channel at the open side of the depression configured to receive the blade retention pin.

According to an embodiment of the present invention, the blade retention pin is formed with upper and lower hooked portions that are adapted to engage over a notch formed in the cutting blade.

According to an embodiment of the present invention, the slider rack is formed with a first linear gear, the blade carriage is formed with a second linear gear, and the pinion gear is positioned between the first linear gear and the second linear gear to transfer movement between the slider button assembly and the blade carriage assembly.

According to an embodiment of the present invention, the automatically retracting utility knife further comprises a blade access panel configured on the rear-half of the housing shell.

According to an embodiment of the present invention, the blade access panel is configured with an access panel lock.

According to an embodiment of the present invention, the slider rack is a C-shaped frame defined by an upper lip formed with a linear gear and extending from a top edge of the slider rack, a lower lip extending from a bottom edge of the slider rack, and a lever arm extending from a rear edge of the slider rack.

According to an embodiment of the present invention, an automatically retracting utility knife, comprising: a rack-and-pinion blade actuation mechanism comprising a slider button configured with a slider pin on an extension arm of the slider button, a slider rack formed with a linear gear and a lever arm, a blade carriage formed with a blade holder adapted to retain a cutting blade and a linear gear on an extension arm of the blade carriage, and a pinion gear operably connected between the linear gear of the slider rack and the linear gear of the blade carriage, wherein the lever arm reversibly disengages from the slider pin when the cutting blade is dragged along a cutting surface thereby disconnecting the slider rack and the slider button and enabling the slider rack to move independently of the slider button; a first tension component attached to the blade carriage to bias the blade carriage, and therefore the cutting blade, to the retracted position; a housing shell defining an interior cavity configured to retain the slider button, the slider rack, the blade carriage, and the first tension component, the housing shell comprising a front edge formed with a blade outlet slot, a rear edge opposite the front edge, a front-half portion, and a rear-half portion; and a second tension component attached to the slider button to bias the slider button toward the front edge of the housing shell.

According to an embodiment of the present invention, the pinion gear is positioned between the linear gear of the slider rack and the linear gear of the blade carriage such that movement of the slider rack in a first direction is transferred to and causes movement of the blade carriage in an opposite direction to the first direction.

According to an embodiment of the present invention, the first tension component automatically retracts the blade carriage, regardless of whether the slider button has been released, when the slider pin is disengaged from the slider rack and the cutting blade is lifted from the cutting surface.

According to an embodiment of the present invention, the second tension component is configured to pull the slider button toward the front edge of the housing shell to reengage the slider pin with the lever arm of the slider rack when the slider button is released.

According to an embodiment of the present invention, the extension arm of the slider button is formed with a slider pin recess adapted to receive the slider pin.

According to an embodiment of the present invention, the slider pin is a rectangular plate comprising a ribbed front face and a rear face formed with a rack lever latching post that is configured to reversibly engage with the lever arm of the slider rack.

According to an embodiment of the present invention, the housing shell is configured with one or more slider pin grooves that are adapted to receive the ribbed front face of the slider pin.

According to an embodiment of the present invention, the automatically retracting utility knife further comprises a slider button channel formed in the front-half portion of the housing shell.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
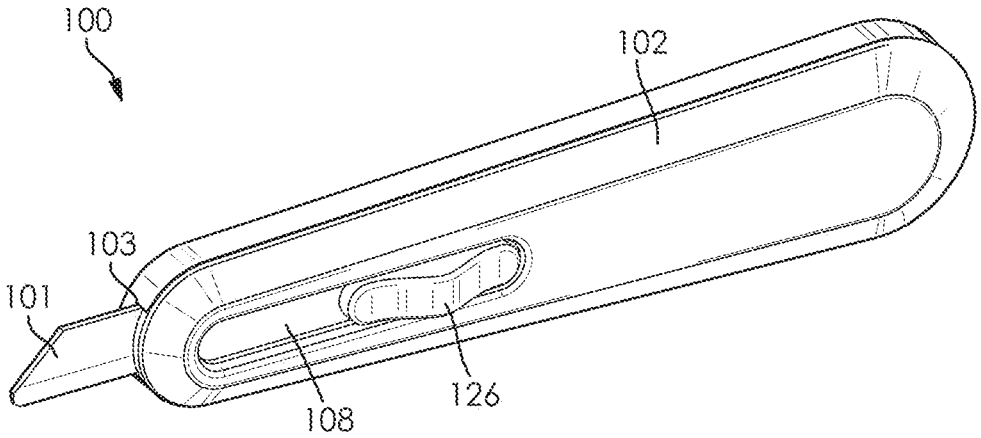
FIG. 1 is a front perspective view of a utility knife in accordance with a first embodiment of the present invention.

The present invention generally relates to a utility knife with a retractable cutting blade. Specifically, embodiments of the present invention relate to a utility knife apparatus with a self-retracting cutting blade, including embodiments where the cutting blade is automatically retracted when the cutting blade is lifted from the cutting surface. The cutting blade of the utility knife is extended and retracted via a blade actuation mechanism. Embodiments of the present invention include a blade actuation mechanism with a rack-and-pinion configuration.

According to an embodiment of the present invention, the utility knife described herein comprises a housing shell, a blade actuation mechanism, a cutting blade, one or more tension components, and one or more weights. Certain embodiments of the present invention may include fewer components or additional components depending on the particular use requirements of the utility knife. One of ordinary skill in the art would appreciate that there are many optional components and configurations for a utility knife, and embodiments of present invention are contemplated for use with any such component or configuration.

According to an embodiment of the present invention, the utility knife is constructed from any suitable variety of durable materials. In a preferred embodiment, the majority of the components of the utility knife are primarily formed from plastic or a plastic composite material. In an alternate embodiment, the components of the utility knife may be formed from a metal or metal alloy. In the preferred embodiment, the utility knife may be constructed from a variety of materials, for example, with i) the housing shell, slider button assembly, and blade carriage assembly being constructed of a plastic material; ii) the tension component and weight from metal; and iii) the cutting blade from ceramic. In a preferred embodiment, certain components of the utility knife may be formed from a specific material based upon the application or function of a given component. As an illustrative example, certain portions of the housing shell be made from glass filled nylon or a polyamide plastic that is more resistant to wear and therefore able to withstand the constant friction the front portion of the utility knife encounters while in contact with a cutting surface. The cutting surface may be the material that is being cut by the utility knife or the surface on which the material is being cut. One of ordinary skill the art would appreciate that there are numerous suitable materials from which the components of the utility knife could be constructed, and embodiments of the present invention are contemplated for use with any such material.

According to an embodiment of the present invention, the housing shell of the utility knife defines an interior cavity configured to receive and retain the blade actuation mechanism, the cutting blade, the one or more tension components, and the one or more weights. In a preferred embodiment, the housing shell may comprise two corresponding halves, a front-half housing shell and a rear-half housing shell, that are configured to retain the other components of the utility knife. The preferred embodiment of the housing shell may further comprise a front housing engagement means and a rear housing engagement means that are configured to align and connect the front-half housing shell with the rear-half housing shell. In some embodiments, the inner surface of the housing shell may be formed with one or more recesses or groves that are configured to retain at least a portion of a tension component. Finally, the preferred embodiment of the housing shell may further comprise a blade outlet slot at the front edge of the utility knife and a lanyard attachment point at the rear edge of the utility knife. In the preferred embodiment, the housing shell may be substantially flat, with an elongated shape that is rounded at each end and generally symmetrical along the longitudinal axis. One of ordinary skill in the art would appreciate that the housing shell could be designed in any number of configurations, and embodiments of the present invention are contemplated for use with any such configuration.

According to an embodiment of the present invention, the housing shell of the utility knife includes a front-half housing shell. In a preferred embodiment, the front-half housing shell comprises a slider button channel, a slider button opening, a slider button post, and a slider button track. In the preferred embodiment, the slider button channel is formed on the exterior surface of the front-half housing shell, while the slider button opening is a void formed in the slider button channel that creates a passage to the internal portion of the utility knife. The slider button post and the slider button track are formed on the inner surface of the front-half housing shell. In some embodiments, the interior of the front-half housing shell may also include slider pin grooves that guide the movement of the slider pin. One of ordinary skill in the art would appreciate that are numerous suitable configurations for the front-half housing shell of the utility knife, and embodiments of the present invention are contemplated for use with any such configuration.

According to an embodiment of the present invention, the exterior surface of the front-half housing shell of the utility knife may be configured with a slider button channel and a slider button opening. In a preferred embodiment, the slider button channel is a depression formed in the front-half housing shell, while the slider button opening is an opening in the front-half housing shell that is substantially contained within the slider button channel. In the preferred embodiment, the slider button channel defines the movement path of the slider button, while the slider button opening allows portions of the slider button to pass through the front-half housing shell to engage with the blade carrier assembly.

According to an embodiment of the present invention, the interior surface of the front-half housing shell may be configured with a slider button post and a slider button track. In a preferred embodiment, the slider button post is a protrusion that extends perpendicularly from the inner surface of the front-half housing shell, while the slider button track is a plurality of ribs and/or channels on the inner surface of the front-half housing shell. In the preferred embodiment, the slider button post is adapted to guide and limit the movement range of the slider button assembly within the housing shell by defining the movement boundary of the slider button assembly, while the slider button track defines and guides the movement of the slider button assembly between a retracted position and an extended position. In some embodiments, the inner surface of the front-half housing shell is also formed with a series of indentations on the inner surface of the slider button channel and inner edge of the slider button opening. In the preferred embodiment, the indentations function as locking points that are configured to reversibly engage with the lock lever tabs of the button lock lever as the cutting blade is extended in a stepwise manner.

One of ordinary skill in the art would appreciate that there are many suitable designs for an inside surface of a front-half housing shell, and embodiments of the present invention are contemplated for use with any such design.

According to an embodiment of the present invention, the housing shell of the utility knife includes a rear-half housing shell. In a preferred embodiment, the rear-half housing shell comprises a blade access panel, blade carriage post, and a blade carriage track. In the preferred embodiment, the blade access panel is located on the front, exterior surface of the rear-half housing shell. The blade carriage post and the blade carriage track are formed on the inner surface of the rear-half housing shell. One of ordinary skill in the art would appreciate that are numerous suitable configurations for the rear-half housing shell of the utility knife, and embodiments of the present invention are contemplated for use with any such configuration.

According to an embodiment of the present invention, the rear-half housing shell includes a blade access panel. In a preferred embodiment, the blade access panel is a removable portion of the rear-half housing shell that provides access to the cutting blade. In the preferred embodiment, the blade access panel further comprises an access panel lock. The access panel lock primarily comprises a rotating latch that extends through an aperture formed in the blade access panel. The access panel lock can be rotated between a locked and an unlocked position. When the access panel lock is rotated to the unlocked position, the blade access panel can be removed from the rest of the rear-half housing shell. In the preferred embodiment, the rotating latch primarily comprises an outer slotted disk that passes through the aperture of the blade access panel and connects to an inner latching component. The inner latching component is configured with an extension flange that hooks behind the inner wall of the rear-half housing shell when the access panel lock is in the locked position, thereby securing the blade access panel in place. Additionally, the exterior surface of the blade access panel or rear-half housing shell may further include a lock indicator that is adapted to show when the access panel lock is engaged. One of ordinary skill in the art would appreciate that are numerous suitable configurations for the rear-half housing shell of the utility knife, and embodiments of the present invention are contemplated for use with any such configuration.

According to an embodiment of the present invention, the interior surface of the rear-half housing shell may be configured with a blade carriage post and a blade carriage track. In a preferred embodiment, the blade carriage post is a protrusion that extends perpendicularly from the inner surface of the rear-half housing shell, while the blade carriage track is a plurality of ribs and/or channels on the inner surface of the rear-half housing shell. In the preferred embodiment, the blade carriage post is adapted to limit the movement range of the blade carriage assembly within the housing shell by defining the movement boundary of the blade carriage assembly, while the blade carriage track defines and guides the movement of the blade carriage assembly between a retracted position and an extended position. One of ordinary skill in the art would appreciate that there are many suitable designs for an inside surface of a rear-half housing shell, and embodiments of the present invention are contemplated for use with any such design.

According to an embodiment of the present invention, the housing shell includes a front housing engagement means and a rear housing engagement means. In a preferred embodiment, the front housing engagement means are corresponding connector or alignment elements configured on the front portion of each of the front-half housing shell and the rear-half housing shell, that are adapted to connect and align the front portion of housing shell. In a preferred embodiment, the rear housing engagement means are, similarly, corresponding connector or alignment elements configured on the rear portion of each of the front-half housing shell and the rear-half housing shell, that are adapted to connect and align the rear portion of housing shell. One of ordinary skill in the art would appreciate that the each of the housing engagement means could be arranged in a variety of configurations, and embodiments of the present invention are contemplated for use with any suitable configuration.

According to an embodiment of the present invention, the housing shell comprises a blade outlet slot and a lanyard attachment point. In a preferred embodiment, the blade outlet slot is formed on the edge of the front portion of the housing shell. In particular, the blade outlet slot is primarily formed from a notch in the front edge of the rear-half housing shell. When the rear-half housing shell is put together with the front-half housing shell, the complete blade outlet slot is fully shaped. Similarly, in a preferred embodiment, the lanyard attachment point is formed on the edge of the rear portion of the housing shell. In particular, the lanyard attachment point is primarily formed from by slot cut into the rear of the rear-half housing shell. When the rear-half housing shell is put together with the front-half housing shell, the complete lanyard attachment point is fully formed, providing an opening through the rear of the housing shell.

According to an embodiment of the present invention, the utility knife includes a blade actuation mechanism. In a preferred embodiment, the blade actuation mechanism primarily comprises a slider button assembly and a blade carriage assembly, and may further include one or more tension components. In some embodiments, the blade actuation mechanism also includes a pinion gear. In the preferred embodiment, a portion of both the slider button assembly and the blade carriage assembly are configured as a linear gear. The linear gear portions of the blade actuation mechanism, along with a pinion gear arranged between those linear gear portions, enable a rack-and-pinion action for the blade actuation mechanism. In particular, a pinion gear that rotates around a pinion gear post formed on the inner surface of the housing shell allows for the movement of the slider button assembly to be transferred to the blade carriage assembly without a direct connection between the slider button assembly and the blade carriage assembly. Furthermore, the mechanical relationship between the slider button assembly and the blade carriage assembly, as facilitated by the pinion gear, allow for movement of the slider button assembly in one direction to cause movement of the blade carriage assembly in the opposing direction. For example, the rack-and-pinion action enables a user of the utility knife to slide the slider button assembly toward the rear of the utility knife, which in turn causes the blade carriage assembly to slide toward the front on the utility knife, extending the cutting blade. As the blade carriage assembly slides toward the front of the utility knife, the cutting blade is extended out of the housing shell through the blade outlet slot. The rack-and-pinion action also enables the cutting blade to be automatically retracted when the cutting blade is lifted off the cutting surface.

According to an embodiment of the present invention, the blade actuation mechanism features a direct connection between the slider button assembly and the blade carriage assembly. In a preferred embodiment, the slider button assembly connects directly to the blade carriage assembly.

This is in contrast to the rack-and-pinion arrangement previously described, which features and indirect linkage between the slider button assembly and the blade carriage assembly. In the preferred embodiment, the direct connection of the slider button assembly and the blade carriage assembly create a direct movement relationship between the slider button assembly and the blade carriage assembly, wherein the slider button assembly and the blade carriage assembly move in unison and in the same direction. For example, as a user slides the slider button of the utility knife forward, the entire slider button assembly, along with the blade carriage assembly, will also be moved toward the front of the utility knife. As the blade carriage assembly slides toward the front of the utility knife, the cutting blade is extended out of the housing shell through the blade outlet slot.

According to an embodiment of the present invention, the blade actuation mechanism includes a slider button assembly. In a preferred embodiment, the slider button assembly comprises a slider button, a slider rack, and a slider pin. In some embodiments, the slider button assembly is secured to the slider button post with a washer or similar retention component that allows the slider button assembly to remain movable. In the preferred embodiment, the slider rack is the primary component of the slider button assembly that interacts with the pinion gear and blade carriage assembly to enable the rack-and-pinion action of the blade actuation mechanism. In an alternate preferred embodiment, the slider button assembly only includes the slider button, where the slider button assembly and blade carriage assembly are directly connected. One of ordinary skill in the art would appreciate there are many suitable configurations for a slider button assembly and embodiments of the present invention are contemplated for use with any such configuration.

According to an embodiment of the present invention, the slider button assembly includes a slider button. In a preferred embodiment, the slider button comprises a button knob and an extension arm. In the preferred embodiment, the button knob is the portion of the slider button that the user touches or interacts with to slide, press, or otherwise engage the blade actuation mechanism, while the extension arm is the portion of the slider button that is configured to either directly or indirectly connect to the blade carriage. In some embodiments, the extension arm of the blade carriage is configured with a slider pin recess that is adapted to receive a slider pin. While the movement of the button knob is largely guided by the slider button channel on the outside of the housing shell, the extension arm of the slider button is guided by portions of the slider button track on the inside surface of the housing shell. In some embodiments, the slider button may be further configured with a button lock lever extending from the back of the button knob or extension arm that enables the slider button to lock the cutting blade at a set extension length. In the preferred embodiment, the button knob may be flat, ribbed, or humped. One of ordinary skill in the art would appreciate that there are many suitable configurations for the slider button depending upon the particular application, and embodiments of the present invention are contemplated for use with any such configuration.

According to an embodiment of the present invention, a button lock lever is formed on the rear surface of the slider button. In a preferred embodiment, the button lock lever is a flexible, substantially V-shaped appendage extending from the rear of the slider button. In the preferred embodiment, one arm of the button lock lever, the flexing arm, is configured to flex against the blade carriage, while the other arm of the button lock lever, the lock tab arm, is configured with lock lever tabs. The button lock lever passes through the slider button opening such that the ends of each arm of the button lock lever are inside of the housing shell, thereby allowing the flexing arm to flexibly abut with the blade carriage and the lock lever tabs to engage with the locking points formed on the inner surface of the housing shell. In the preferred embodiment, button lock lever is configured to enable stepwise movement of the slider button and thereby the stepwise extension of the cutting blade. As the slider button is depressed inward, the flexing arm of the button lock lever flexes against the blade carriage, causing the lock tab arm to disengage with the locking points. The slider button, and therefore the cutting blade, can then be extended or retracted as desired. When the blade has been moved to the desired position, the slider button can be released, causing the flexing arm to return to its relaxed position and the lock tab arm to reengage with the locking points. The various locking points formed on the inside of the housing shell allow the slider button, and therefore the cutting blade, to be extended and retracted in a stepwise manner.

According to an embodiment of the present invention, the extension arm of the slider button connects directly to the blade carriage assembly. In a preferred embodiment, one or more carriage engagement posts are formed on the extension arm of the slider button. In the preferred embodiment, each carriage engagement post is configured to connect to a hole on the blade carriage or fit with one or more flanges on the blade carriage. This arrangement allows movement of the slider button to be directly transferred to the blade carriage assembly. One of ordinary skill in the art would appreciate that there are many suitable designs and configurations for a carriage engagement post, and embodiments of the present invention are contemplated for use with any such design or configuration.

According to an embodiment of the present invention, the extension arm of the slider button is indirectly linked to the blade carriage assembly. In a preferred embodiment, the slider button links to the blade carriage assembly via the linkage created by the slider rack, slider pin, and pinion gear. In the preferred embodiment, the slider pin recess formed in the extension arm of the slider button allows a portion of the slider pin to pass through the extension arm to reversibly engage with the lever arm on the slider rack. This arrangement allows movement of the slider button to be indirectly transferred to the blade carriage assembly via the rack-and-pinion arrangement created between the slider rack, the blade carriage extension arm, and pinion gear.

According to an embodiment of the present invention, the extension arm of the slider button is formed with a slider pin recess. In a preferred embodiment, the slider pin recess is a depression formed on the front of the slider button extension arm that is configured to retain the slider pin. In the preferred embodiment, slider pin recess is formed such that the slider pin can move up and down within the boundaries of the slider pin recess. The slider pin recess also includes a hole or void that allows a portion of the slider pin to pass completely through the extension arm to engage with the slider rack. In some embodiments, in addition to the slider pin recess, the extension arm is also configured with a slider rack engagement flange that extends from the back of the extension arm. In the preferred embodiment, the slider rack engagement flange is configured to interact with the slider rack. One of ordinary skill in the art would appreciate that there are many suitable ways to form a slider pin recess, and embodiments of the present invention are contemplated for use with any such formation.

According to an embodiment of the present invention, the extension arm of the slider button is configured with a slider post slot. In a preferred embodiment, the slider post slot is an opening formed in the extension arm of the slider button that allows the slider button post to pass through the extension arm of the slider button. By passing through the slider button, the slider button post can guide and limit the movement of the slider button, while also providing an attachment point for the washer that secures the slider button to the housing shell without completely immobilizing the slider button. The slider button slot may be configured in any suitable width to accommodate the slider button post and of any suitable length to facilitate the sliding motion of the slider button. In some embodiments, the extension arm of the slider button also includes at least one tension component attachment point.

According to an embodiment of the present invention, the slider button assembly includes a slider pin. In a preferred embodiment, the slider pin primarily comprises a plate portion configured with ribbing on the front of the plate portion and a rack lever latching post extending perpendicularly from the rear of the plate portion. In the preferred embodiment, the plate portion is configured to rest inside the slider pin recess of the slider button extension arm. The plate portion will also be able to slide within the slider pin recess to permit the slider pin to reversibly engage with the slider rack. In the preferred embodiment, the rack lever latching post passes through the slider button extension arm via the hole formed in the slider pin recess. After passing through the slider button extension arm, the rack lever latching post is able to reversibly engage with the lever arm of the slider rack. In particular, a hook or catch on the rack lever latching post engages with a corresponding hook or catch of the lever arm of the slider rack In the preferred embodiment, the ribbing on the front of the plate portion is configured to correspond to the slider pin grooves on the inside of the housing shell. One of ordinary skill in the art would appreciate that there are many suitable designs for a slider pin, and embodiments of the present invention are contemplated for use with any such design.

According to an embodiment of the present invention, the slider button assembly includes a slider rack. In a preferred embodiment, the slider rack is an essentially C-shaped frame defined by an upper and lower lip extending perpendicularly from the rear of main body of the slider rack. In the preferred embodiment, the slider rack comprises a linear gear formed on the underside of the upper lip and a lever arm formed on the main body of the slider rack. The lever arm further comprises a hook or catch that reversibly engages with a corresponding hook or catch on the rack lever latching post of the slider pin. In the preferred embodiment, the C-shape of the slider rack enables the slider rack to receive the blade carriage between the upper and lower lip of the slider rack. In particular, the two components are aligned so that the extension arm of the blade carriage rests on the topside of the lower lip of the slider rack, thereby causing the linear gear formed on the underside of the upper lip of the slider rack to align with the linear gear formed on the topside of the blade carriage extension arm. With the linear gear of both the slider rack and the blade carriage aligned, a pinion gear can be inserted between the two components so that movement of one component can be transferred to the other due to the rack-and-pinion relationship created between those components. One of ordinary skill in the art would appreciate that there are many suitable designs for a slider rack, and embodiments of the present invention are contemplated for use with any such design.

According to an embodiment of the present invention, the slider rack includes a series of grooves and channels that correspond with the slider button and blade carriage tracks on the inside of the housing shell. In the preferred embodiment, the front of the slider rack includes a groove at the top of the slider rack that interacts with and is guided by portions of the slider button track on the front-half housing shell. On the other hand, the upper and lower lips of the slider rack interact with and are guided by portions of the blade carriage track on the rear-half housing shell. In some embodiments, the upper lip of the slider rack extends from the top edge of the slider rack, while the lower lip of the slider rack is set back from the bottom edge of the slider rack, thereby forming a groove defined by the bottom edge of the slider rack and the perpendicularly extending lower lip. In the preferred embodiment, the groove formed by the bottom edge of the slider rack and the lower lip of the slider rack corresponds to a portion of the blade carriage track. Overall, the slider rack is designed to correspond to features of both the front-half housing shell and rear-half housing shell. Additional features of the slider rack may include, but are not limited to, a notch that corresponds to the slider button post and an upper lip overhang that extends the upper lip past the front edge of the main body of the slider rack. One of ordinary skill in the art would appreciate there are many option components and features that could be incorporated into a slider rack, and embodiments of the present invention are contemplated for use with any such component or feature.

According to an embodiment of the present invention, the slider rack includes a lever arm formed from the main body of the slider rack. In a preferred embodiment, the lever arm is a flexible appendage extending from the rear edge of the main body of the slider rack. In the preferred embodiment, the lever arm extends from the edge of the slider rack in the middle of an open notch that is cutout from the main body of the slider rack. The open notch provides sufficient room for the lever arm to flex when the lever arm is engaged with the slider pin. One of ordinary skill would appreciate that there are many possible configurations for a lever arm, and embodiments of the present invention are contemplated for use with any such configuration.

According to an embodiment of the present invention, the blade actuation mechanism includes a blade carriage assembly. In a preferred embodiment, the blade carriage assembly comprises a blade carriage, a blade holder cover, and a blade retention pin. In some embodiments, the blade carriage assembly is secured to the blade carriage post with a washer or similar retention component that allows the blade carriage assembly to remain movable. In the preferred embodiment, the blade carriage is the primary component of the blade carriage assembly that interacts with the pinion gear and slider button assembly to enable the rack-and-pinion action of the blade actuation mechanism. In an alternate preferred embodiment, the slider button assembly and blade carriage assembly are directly connected, as opposed to an indirect connection via the pinion gear. One of ordinary skill in the art would appreciate there are many suitable configurations for a blade carriage assembly and embodiments of the present invention are contemplated for use with any such configuration.

According to an embodiment of the present invention, the blade carriage assembly includes the blade carriage. In a preferred embodiment, the blade carriage comprises a blade holder and an extension arm. In the preferred embodiment, the blade holder is the portion of the blade carriage that is configured to retain the cutting blade, while the extension arm is the portion of the blade carriage that is configured to either (i) directly connect to the slider button of the slider button assembly via the carriage engagement posts on the slider button or (ii) indirectly connect to the slider rack of the slider button assembly via the pinion gear. In the preferred embodiment, the blade holder is formed at one end of the blade carriage, with the extension arm extending away from the blade holder. The extension arm is attached to the back of the blade holder to create a slight offset between the extension arm and blade holder, although the two components generally form a straight line. The offset between the blade holder and the extension arm causes (i) the blade holder to align with the main body of the slider rack, (ii) the extension arm of the blade carriage to be positioned between the upper and lower lip of the slider rack, and (iii) for the slider rack and blade holder to serve as a stop block to each other. One of ordinary skill in the art would appreciate that the blade carriage could be designed in a variety of configurations, and embodiments of the present invention are contemplated for use with any such configuration.

According to an embodiment of the present invention, the blade carriage includes a blade holder. In a preferred embodiment, the front surface of the blade holder is formed with a depression adapted to receive a cutting blade, a plurality of blade holder cover attachment points, and a channel adapted to receive the blade retention pin. In the preferred embodiment the blade depression is defined by a rim or raised lip that borders all but one side of the blade depression. The blade depression is configured to receive the cutting blade in at least two different orientations, with a triangular bulge that is formed on the rim being adapted to define the possible orientations of the cutting blade. By receiving the blade in at least two orientations the utility knife can be used of both right and left handed users. In particular, the generally symmetrical shape of the utility knife enables ambidextrous use because the longitudinal axis of the button knob of the slider button is aligned with the longitudinal axis of the housing shell. When the cutting blade is in a first orientation relative to the longitudinal axis of the utility knife, the sharpened edge of the cutting blade faces the first longitudinal side of the utility knife and is configured for use by a right-handed user. Conversely, when the cutting blade is in a second orientation relative to the longitudinal axis of the utility knife, the sharpened edge of the cutting blade faces the second longitudinal side of the utility knife and is configured for use by a left-handed user. At the open side of the blade depression is the channel that is adapted to receive the blade retention pin. In the preferred embodiment, the retention pin channel is configured to allow the blade retention pin to slide up and down within the channel and is also formed with a lock slot in the bottom of the channel that is adapted to receive a post extending from the rear side of the blade retention pin. Additionally, the retention pin channel is formed at a sufficient depth so that when the blade retention pin is in the channel the front surface of the blade retention pin is flush with the surface of the blade depression. In the preferred embodiment, the blade holder is also formed with a plurality of blade holder cover attachment points that are configured to engage with corresponding portions of the blade holder cover. One of ordinary skill in the art would appreciate that there are many suitable configurations for a blade holder, and embodiments of the present invention are contemplated for use with any such configuration.

According to an embodiment of the present invention, the retention pin channel includes a lock slot. In a preferred embodiment, the lock slot interrelates with the post on the blade retention pin to define the locked and unlocked positions of the blade retention pin. The lock slot is also formed with nodes that engage with the post in order to secure the blade retention pin place in position over a notch formed in the cutting blade. In the preferred embodiment, a hooked portion of the blade retention pin securely engages with the notch of the cutting blade when the blade retention pin is moved to the top or bottom of the lock slot. In either of the locked positions, a portion of the blade retention pin may extend below the blade carriage. When the retention pin is moved to the middle of the lock slot, the blade retention pin is disengaged from the cutting blade, allowing the cutting blade to be removed from the blade holder. In the preferred embodiment, the rear surface of the blade holder includes a blade orientation indicator that illustrates the possible orientations in which the cutting blade can be inserted into the blade holder. The rear surface of the blade holder also includes a lock indicator that shows whether the blade retention pin is in the locked or unlocked position, typically with the unlocked position being in the middle of the lock slot. In the preferred embodiment, the blade orientation indicator also indicates which way the retention pin should be moved in order to lock a cutting blade that has been inserted into the blade holder in one of the indicated orientations. As an illustrative example, the blade retention pin will be moved to the top of the lock slot when locking the cutting blade in one of the indicated orientations and moved to the bottom of the lock slot when locking the cutting blade in the other orientation.

According to an embodiment of the present invention, the blade carriage includes a blade retention pin. In a preferred embodiment, the blade retention pin is configured to secure the cutting blade in the blade holder and comprises a front side with an upper and lower hooked portion and a rear side with a post. In the preferred embodiment, the upper and lower hooked portions extend away from the surface of the front side of the retention pin and are configured to engage with a notch in the cutting blade in order to secure the cutting blade in the blade holder. The blade retention pin is configured to receive the cutting blade between the hooked portions when the notch on the cutting blade is aligned between the hooked portions of the blade retention pin. In particular, with the blade retention pin in the unlocked position, the cutting blade can be inserted into the blade holder because the front surface of the blade retention pin is flush with the surface of the depression of the blade holder. Once the cutting blade is positioned in the depression of the blade holder, the blade retention pin can be moved into a locked position causing one of the hooked portions of the blade retention pin to engage with the notch of the cutting blade. In the preferred embodiment, the blade retention pin further comprises a post extending from the rear of the blade retention pin that engages with lock slot of the retention pin channel. One of ordinary skill in the art would appreciate that there are many suitable designs for a blade retention pin, and embodiments of the present invention are contemplated for use with any such design.

According to an embodiment of the present invention, the blade carriage includes an extension arm. In a preferred embodiment, the blade carriage extension arm is configured to engage with, directly or indirectly, the slider button assembly and is guided by the blade carriage track. To facilitate the connection with the slider button assembly, the blade carriage extension arm may be formed with a linear gear, a hole to engage with a blade carriage engagement post, one or more flanges formed to fit around a blade carriage extension post, or any combination thereof. In a first preferred embodiment, the blade carriage is indirectly engaged with the slider button assembly via the pinion gear. In particular, a linear gear formed on top of the extension arm of the blade carriage indirectly engages with a linear gear on the upper lip of the slider rack via a pinion gear positioned between those components, thereby allowing movement of one of those components to be transferred to the other. The linear gear of the blade carriage extension arm aligns with the linear gear of the slider rack due to the offset between the blade holder and extension arm of the blade carriage. In a second preferred embodiment, the blade carriage is directly connected to the slider button, thereby enabling movement of the slider button assembly to be directly transferred to the blade carriage assembly. Specifically, a carriage engagement post formed on the slider button either (i) directly connects to a hole formed in the blade carriage extension arm or (ii) is fitted between one or more flanges formed on the blade carriage extension arm.

According to an embodiment of the present invention, the extension arm of the blade carriage is configured with a carriage post slot. In a preferred embodiment, the carriage post slot is an opening formed in the extension arm of the blade carriage that allows the blade carriage post to pass through the extension arm of the blade carriage. By passing through the blade carriage, the blade carriage post can guide and limit the movement of the blade carriage, while also providing an attachment point for the washer that secures the blade carriage to the housing shell without completely immobilizing the blade carriage. The carriage post slot may be configured in any suitable width to accommodate the blade carriage post and of any suitable length to facilitate the sliding motion of the blade carriage. In some embodiments, the extension arm of the blade carriage also includes at least one tension component attachment point. In some embodiments, the extension arm of the blade carriage includes a pair of parallel rails on the rear side of the extension arm. In a preferred embodiment, the parallel rails are adapted to guide the blade carriage extension arm relative to both the blade carriage post and portions of the blade carriage track. In some embodiments, the parallel rails also partially retain the tension component attached to the blade carriage. In some embodiments, the extension arm of the blade carriage also includes a pinion gear retention flange extending perpendicularly from the top, front edge of the blade carriage extension arm. In the preferred embodiment, the pinion gear retention flange flanks, and is coextensive with, the linear gear of the blade carriage extension arm and is adapted to prevent the pinion gear from sliding off the pinion gear post.

According to an embodiment of the present invention, the blade carriage assembly includes a blade holder cover. In a preferred embodiment, the blade holder cover is attached to the blade holder and covers both the depression for the cutting blade, as well as the retention pin channel. In the preferred embodiment, the blade holder cover is configured with clip arms that are adapted to engage with the blade holder cover attachment points on the blade holder, thereby forming an opening through which the cutting blade projects. In some embodiments, the blade holder cover is detachable from the blade holder, while in other embodiments it is permanently fixed to the blade holder. In the preferred embodiment, the blade holder cover engages with the blade holder such that an opening is maintained at the top and bottom of the retention pin channel, thereby enabling the retention pin to slide between an upper locked position and a lower lock position. In either of the locked positions, a portion of the blade retention pin may extend beyond the edge of the blade carriage.

According to an embodiment of the present invention, the blade actuation mechanism includes a pinion gear. In a preferred embodiment, the pinion gear is a toothed wheel with a hole that is configured to engage with and rotate on the pinion gear post. In the preferred embodiment, the pinion gear engages with the pinion gear post via a hole formed in the center of the pinion gear. The cogs of the pinion gear are configured to engage between the linear gear portions of the slider rack and blade carriage. In particular, the pinion gear allows for movement of the slider button assembly to be indirectly transferred to the blade carriage assembly through a rack-and-pinion relationship between the components. Furthermore, the pinion gear enables a blade actuation mechanism in which movement of the slider button assembly in one direction causes movement of the blade carriage assembly in the opposite direction. One of ordinary skill in the art would appreciate that there many suitable configurations for a pinion gear, and embodiments of the present invention are contemplated for use with any such pinion gear.

According to an embodiment of the present invention, the blade actuation mechanism includes one or more tension components. In a preferred embodiment, the tension components are springs or other biasing mechanisms that are configured to urge components of the blade actuation mechanism in a particular direction. In particular, the tension components are adapted to cause or assist with the retraction of the cutting blade, by biasing components of the blade actuation mechanism to a retracted position. In the preferred embodiment, the tension components may be partially retained in recesses or groves formed on the inner surface of the housing shell. Examples of suitable tension components include, but are not limited to, springs, elastic bands, and similar pliant components. In the preferred embodiment, a tension component may be attached between a tension component attachment point on the housing shell and a tension component attachment point on the blade actuation mechanism. In some embodiments, a first tension component attaches between the housing shell and the slider button assembly, while a second tension component attaches between the housing shell and the blade carriage assembly. In some embodiments, however, there is only one tension component, with the tension component connecting between the housing shell and either the blade carriage assembly or the slider button assembly. One of ordinary skill in art would appreciate that there are numerous types and configurations for a tension component, and embodiments of the present invention are contemplated for use with any such tension component.

According to an embodiment of the present invention, the utility knife may be configured with one or more tension component attachment points that may be formed on the inner surface of the housing shell, as well as components of the blade actuation mechanism. In a preferred embodiment, each tension component attachment point (or anchor point) is a peg, hook, or hole that is adapted to receive or connect to a tension component. One of ordinary skill in the art would appreciate that there are many arrangements for tension component attachment points, and embodiments of the present invention are contemplated for use with any such arrangement.

According to an embodiment of the present invention, the utility knife includes one or more weights. In a preferred embodiment, the one or more weights are retained within various cavities formed on the inside of the housing shell and may be secured in place via a friction fit, an adhesive, or any combination thereof. In a preferred embodiment, the one or more weights provide a means of balancing the utility knife in the hand of a user so as to maximize the ergonomics of the utility knife. Furthermore, a balanced utility knife is easier to control and therefore safer to use than an unbalanced utility knife. In the preferred, the one or more weights are positioned at the opposite end of the utility knife from the cutting blade. This arrangement allows the weights to balance out the relatively heavier components of the cutting blade and blade carriage assembly that are located at the front of the utility knife. One of ordinary skill in the art would appreciate that there are numerous uses for a weight in a utility knife, and embodiments of the present invention are contemplated to take advantage of any such use.

According to an embodiment of the present invention, the utility knife may include a cutting blade. In a preferred embodiment, the cutting blade may be removable engaged with the holder of the blade carriage. The cutting blade may be made from any suitable material, including, but not limited to, metal, ceramic, or any combination thereof. In the preferred embodiment, the cutting blade is made from a ceramic material that is capable of withstanding extended use without becoming dull or unusable. Ceramic materials appropriate for such construction include, but are not limited to, zirconium oxide. In the preferred embodiment, the cutting blade is configured with a notch that is adapted to engage with a hooked portion of the blade retention pin. One of ordinary skill in the art would appreciate that there are numerous configurations and materials that might be used for the cutting blade, and embodiments of the present invention are contemplated for use with any such material or configuration.

According to an embodiment of the present invention, the utility knife has an automatically retracting cutting blade. In a preferred embodiment, the cutting blade of the utility knife is extended by either moving the slider button toward the front of the utility knife or moving the slider button toward the rear of the utility knife. Movement of the slider button causes the one or more tension components to be stretched from its neutral state, thereby applying pressure to the blade carriage that will cause the cutting blade to be retracted. In the preferred embodiment, the cutting blade is automatically retracted when the cutting blade is lifted off of the cutting surface, regardless of whether the user has released the slider button. In an alternate embodiment, the cutting blade is automatically retracted when the user releases the slider button. One of ordinary skill in the art would appreciate that there are many methods to creating an automatically retracting blade, and embodiments of the present invention are contemplated for use with any such method.

According to an embodiment of the present invention, the cutting blade of the utility knife is extended by moving the slider button toward the front of the utility knife. In a preferred embodiment, moving the slider button toward the front of the utility knife will extend the cutting blade when there is a direct connection between the slider button assembly and the blade carriage assembly of the blade actuation mechanism. In particular, there is a direct movement relationship between the slider button assembly and the blade carriage assembly, wherein the slider button assembly and the blade carriage assembly move in unison and in the same direction. When a user moves the slider button towards the front of the utility knife, the blade carriage is also moved towards the front of the utility knife, extending the cutting blade through the blade outlet slot. In the preferred embodiment, the cutting blade automatically retracts when the user releases the slider button.

According to an embodiment of the present invention, the cutting blade of the utility knife is extended by moving the slider button toward the rear of the utility knife. In a preferred embodiment, moving the slider button toward the rear of the utility knife will extend the cutting blade when there is an indirect connection between the slider button assembly and blade carriage assembly of the blade actuation mechanism that is facilitated by a rack-and-pinion arrangement of those components. In particular, there is an indirect movement relationship between the slider button assembly and the blade carriage assembly, wherein the slider button assembly and the blade carriage assembly move in opposite directions to cause the extension of the cutting blade. When a user moves the slider button towards the rear of the utility knife, the movement of the slider button assembly is transferred to the blade carriage assembly via a pinion gear. The pinion gear facilitates a rack-and-pinion relationship between the slider button assembly and the blade carriage assembly such that the rearward movement of the slider button assembly causes forward movement of the blade carriage assembly, thereby causing extension of the cutting blade through the blade outlet slot. In a first preferred embodiment, the rack-and-pinion relationship enables the cutting blade to be automatically retracted when the cutting blade is lifted off the cutting surface, regardless of whether the slider button has been released. In a second preferred embodiment, the cutting blade will automatically retract only after the user releases the slider button.

According to an embodiment of the present invention, the slider button assembly and the blade carriage assembly of the blade actuation mechanism have a rack-and-pinion relationship facilitated by a pinion gear. In a preferred embodiment, when the cutting blade is retracted, the slider button assembly is also in the retracted position at the forward position of the slider button channel. In the retracted position, the slider pin on the slider button extension arm is engaged with the lever arm of the slider rack, allowing movement of the slider button to be directly transferred to the slider rack. When the slider button is moved toward the rearward position of the slider button channel, the slider rack is moved toward the rear of the utility knife, thereby causing the blade carriage assembly to move toward the front of the utility knife and the cutting blade to be extended through the blade outlet slot. In the preferred embodiment, the pinion gear transfers and converts rearward movement of the slider rack into forward movement of the blade carriage. Depending upon the particular arrangement of components, the cutting blade will may be automatically retracted when the cutting blade is lifted off of the cutting surface or when the user releases the slider button.

According to an embodiment of the present invention, a blade actuation mechanism with a rack-and-pinion relationship between the slider button assembly and the blade carriage assembly is configured to automatically retract the cutting blade when the cutting blade is lifted from the cutting surface. In a preferred embodiment, the rearward movement of the slider button assembly causes the ribs on the front of the plate portion of the slider pin to interact with the slider pin grooves in the housing shell. The interaction between the ribbing on the slider pin and the grooves in the housing shell causes the entire slider pin to move from its resting position within the slider pin recess of the slider button extension arm. This movement of the slider pin causes the slider pin to flex the lever arm of the slider rack as the slider button is move rearward. As the cutting blade is pulled along the cutting surface, the blade carriage is pulled slightly forward, which in turn causes the slider rack to move slightly rearward due to the rack-and-pinion relationship between those components. As the slider rack moves slightly rearward, the lever arm of the slider rack disengages from the slider pin in the slider button as the flex in the lever arm causes it to return to is relaxed position. With the lever arm disengaged from the slider pin, the slider rack and slider button are no longer connected and are able to move independently. Therefore, when the cutting blade is removed from the cutting surface, the blade carriage assembly is automatically retracted toward the rear of the utility knife by a tension component because the slider rack has been disconnected from the slider button and there is no linkage to hold the cutting blade in the extended position. Furthermore, as the blade carriage moves toward the rear of the utility knife to retract cutting blade through the blade outlet slot, the rack-and-pinion arrangement causes the slider rack to move toward the front of the utility knife independently of the slider button. When the user releases the slider button, a separate tension component attached to the slider button causes the slider button to return to the retracted position in the forward portion of the slider button channel. As the slider button returns to the retracted position, the ribbing on the slider pin and the grooves in the housing shell cause the slider pin to move back to its starting position within the slider pin recess and to reengage with the lever arm of the slider rack. Overall, this configuration provides a utility knife that automatically retracts the cutting blade, whether or not the user releases the slider button, which increases the safety of the utility knife. Additionally, this configuration enables a cutting blade extension motion that is in the same direction as the cutting motion, which reduces hand fatigue.

According to an embodiment of the present invention, a blade actuation mechanism with a rack-and-pinion relationship between the slider button assembly and the blade carriage assembly is configured to automatically retract the cutting blade only after the user releases the slider button. In contrast to the embodiment of the previously described blade actuation mechanism that automatically retracts the cutting blade when the cutting blade is lifted from the cutting surface, this alternate embodiment of a rack-and-pinion blade actuation mechanism does not cause the slider rack to disengage from the slider button as the cutting blade is pulled along the cutting surface. Therefore, the slider rack and slider button cannot move independently and the cutting blade and blade carriage will not be retracted until the slider button is released. In particular, because the slider rack does not disconnect from the slider button, a linkage remains that holds the blade carriage in the extended position. When the slider button is released, one or more tension components cause the blade actuation mechanism to return to the retracted position. Generally, as the slider button is moved toward the forward position of the slider button channel, the slider rack is moved toward the front of the utility knife, thereby causing the blade carriage assembly to move toward the rear of the utility knife, retracting the cutting blade back through the blade outlet slot. Overall, this configuration enables a cutting blade extension motion that is in the same direction as the cutting motion, which reduces hand fatigue.

According to an embodiment of the present invention, the utility knife has a manually retracting blade. In a preferred embodiment, the cutting blade of the utility knife can be extended by pushing the button knob of the slider button forward in the slider button channel or retracted by pulling the button knob of the slider button to the rear of the slider button channel. In the preferred embodiment, the blade actuation mechanism of a manually retractable utility knife primarily comprises a carriage engagement post formed on the extension arm of the slider button that engages with a hole formed in the blade carriage extension arm, thereby allowing movement of the slider button to be transferred directly to the blade carriage. In some embodiments, the cutting blade can be incrementally extended to cut through materials of varying thicknesses. Accordingly, the slider button may be configured to extend and lock at multiple positions that correspond to the varying extension of the blade (e.g. a first position where the blade is totally retracted, a second position where the blade is partially extended, and a third position where the blade is totally extended). To extend or retract the blade, the slider button could be depressed and moved to the appropriate position. Once the blade is extended or retracted to the appropriate position, the slider button could then be released and the blade would be locked into that position. In the preferred embodiment, locking tabs formed on a lock lever on the rear of the slider button reversibly engage with locking points formed on the inner surface of the slider button channel. In some embodiments, the blade actuation mechanism of a manually retractable utility knife includes a tension component to assist with the retraction of the blade carriage and cutting blade when the slider button disengages from the locking points.

Turning now to FIG. 1, a front perspective view of a utility knife with a rack-and-pinion blade actuation mechanism, in accordance with an embodiment of present invention. In a preferred embodiment, the utility knife 100 primarily comprises a housing shell 102 configured to internally retain a blade actuation mechanism. In the preferred embodiment, the blade actuation mechanism features a slider button assembly and blade carriage assembly that have a rack-and-pinion relationship. The rack-and-pinion blade actuation mechanism enables a user to extend the cutting blade 101 through the blade outlet slot 103 at the front edge of the utility knife 100 by sliding the slider button 126 of the slider button assembly towards the rear of the slider button channel 108 formed at the front portion of the utility knife 100.

Figure 2A:
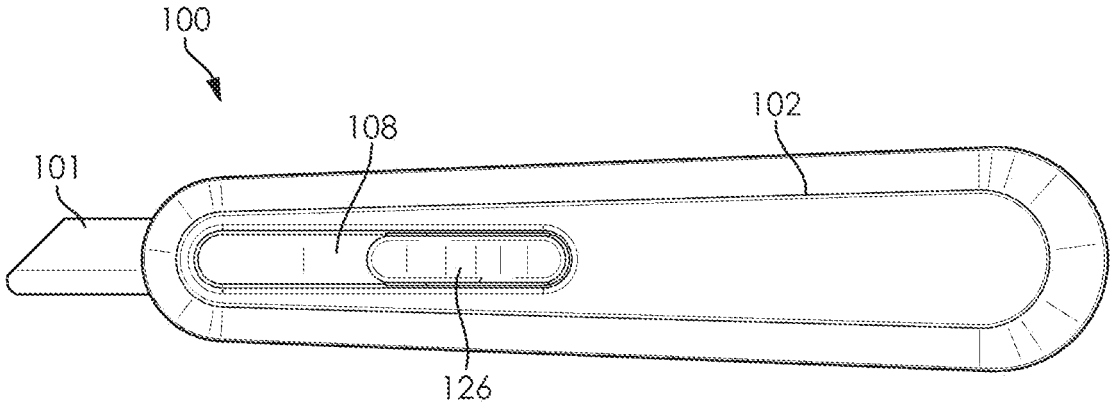
FIGS. 2A and 2B are front views of a utility knife in accordance with a first embodiment of the present invention.
Figure 2B:
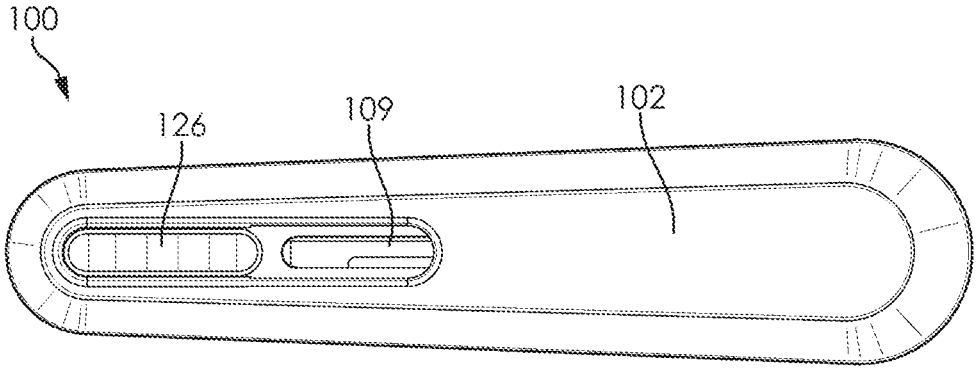

Turning now to FIGS. 2A and 2B, front views of a utility knife with a rack-and-pinion blade actuation mechanism, in accordance with an embodiment of present invention. As shown in FIG. 2A, the rack-and-pinion blade actuation mechanism enables a user to extend the cutting blade 101 by sliding the slider button 126 of the slider button assembly towards the rear of the slider button channel 108 that is formed on the front of the housing shell 102. As shown in FIG. 2B, the cutting blade is retracted when the slider button 126 is in the forward position. Additionally, FIG. 2B, illustrates that the slider button 126 of the slider button assembly passes through a slider button opening 109 that is formed in the slider button channel 108.

Figure 3A:
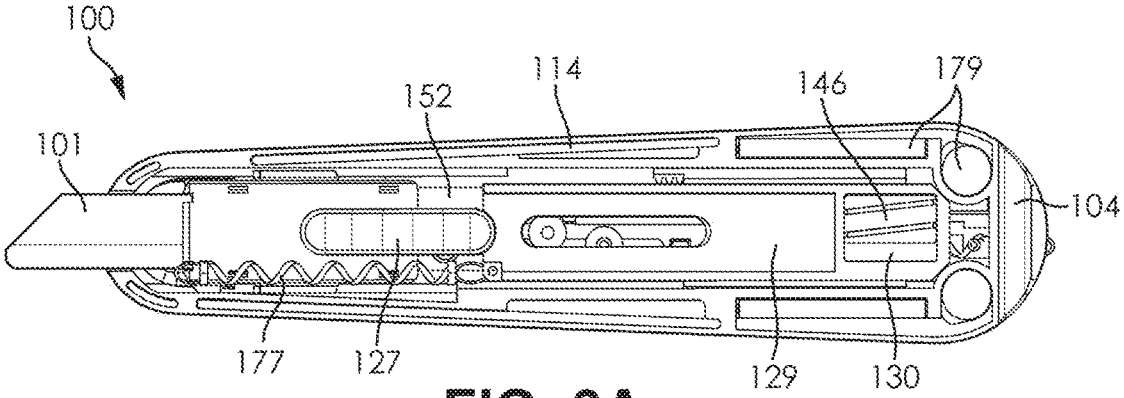
FIGS. 3A and 3B are front and rear internal views of a utility knife with the cutting blade in an extended position in accordance with a first embodiment of the present invention.
Figure 3B:
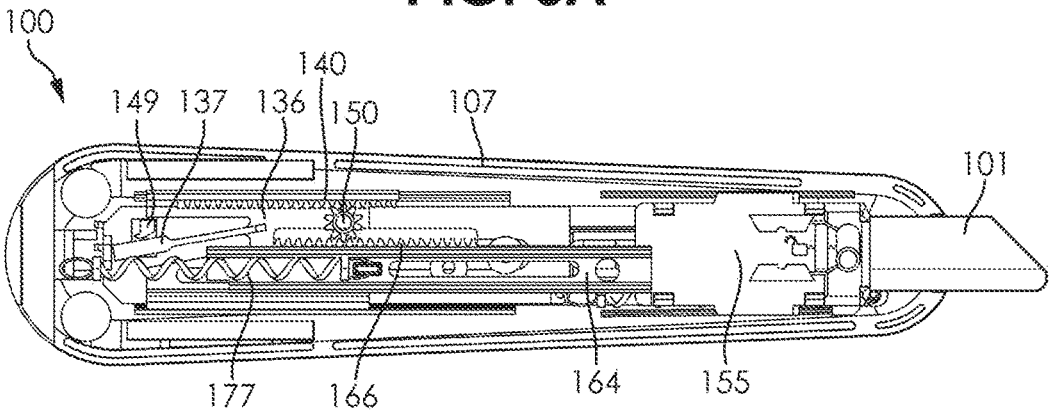

Turning now to FIGS. 3A and 3B, front and rear internal views of a utility knife with a rack-and-pinion blade actuation mechanism and a cutting blade in the extended position, in accordance with an embodiment of present invention. In a preferred embodiment, the cutting blade 101 is extended when the blade carriage assembly 152 is moved forward as the slider button assembly is moved to the rearward position. In the preferred embodiment, the rearward movement of the button knob 127, slider button extension arm 129, and slider rack are transferred to the blade carriage assembly 152 via a pinion gear 150. In particular, as the slider button assembly is moved toward the rear of the utility knife 101, a hooked portion 149 of the rack lever latching post of the slider pin 146 engages with a corresponding hooked portion of the lever arm 137 extending from the main body 136 of the slider rack thereby causing the slider rack to be moved toward the rear of the utility knife 100 when the button knob 127 and slider button extension arm 129 moved in that direction. As the slider rack is moved towards the rear of the utility knife, a linear gear 140 on the slider rack causes rotation of a pinion gear 150, which is in turn transferred to a linear gear 166 formed on the blade carriage extension arm 164. As a result, the rearward movement of the slider button assembly causes the forward movement of the blade carriage assembly 152 so that the cutting blade 101 within the blade holder 155 can be extended. Furthermore, as the slider button assembly is moved towards the rear of the utility knife 100, the slider pin 146 moves up within the slider pin recess 130, which causes the slider pin 146 to flex the lever arm 137 of the slider rack. As the cutting blade 101 is pulled along the cutting surface, the blade carriage assembly 152 moves slightly forward, which in turn causes the slider rack to move slightly rearward due to the rack-and-pinion relationship between those components. When slider rack moves slightly rearward, the lever arm 137 of the slider rack disengages from the slider pin 146 in the slider button as the flex in the lever arm causes it to return to is relaxed position. With the lever arm 137 disengaged from the slider pin 146, each of the slider rack, slider button, and blade carriage become disconnected from one and other, thereby allowing the tension components 177 to return the blade carriage assembly 152 to the retracted position when the cutting blade 101 is removed from the cutting surface and the slider button assembly to the forward position when the slider button knob 127 is released.

Figure 4A:
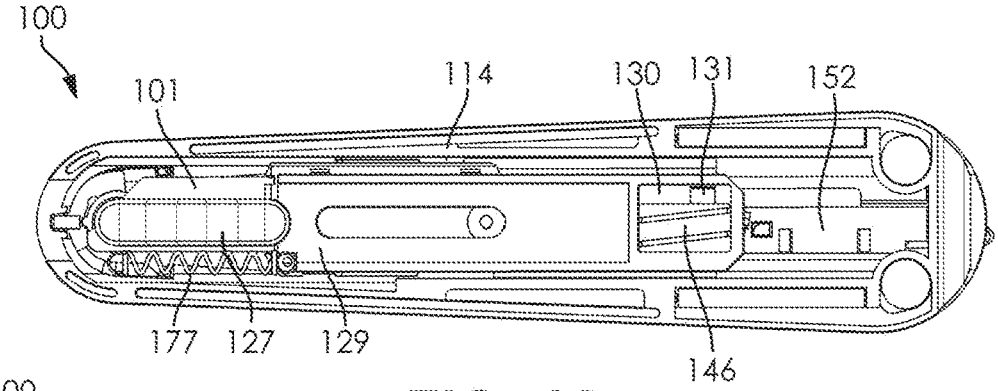
FIGS. 4A and 4B are front and rear internal views of a utility knife with the cutting blade in retracted position in accordance with a first embodiment of the present invention.
Figure 4B:
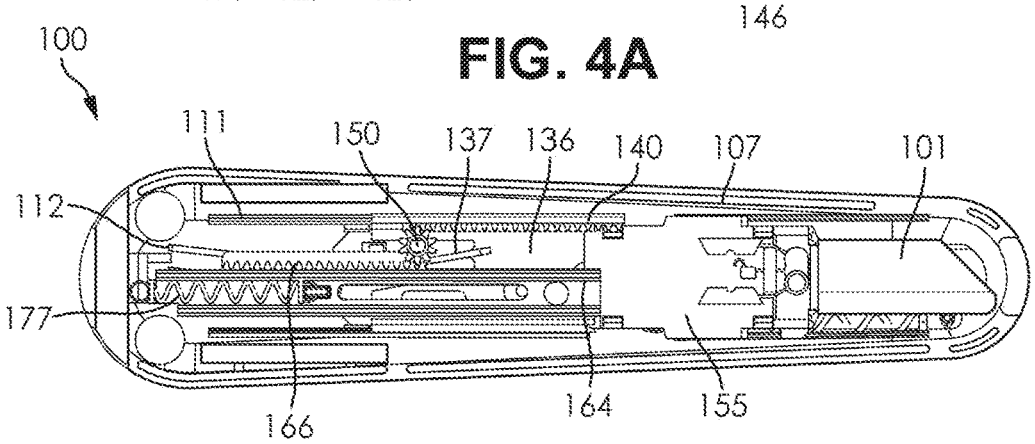

Turning now to FIGS. 4A and 4B, front and rear internal views of a utility knife with a rack-and-pinion blade actuation mechanism and a cutting blade in the retracted position, in accordance with an embodiment of present invention. In a preferred embodiment, the cutting blade 101 is retracted when the blade carriage assembly 152 is in the rear position and the slider button is in the front position. When the cutting blade 101 is removed from the cutting surface, the blade carriage assembly 152 is automatically retracted toward the rear of the utility knife 100 by a tension component 177 because the lever arm 137 of the slider rack has been disconnected from the slider button extension arm 129 and there is no linkage to hold the cutting blade 101 in the extended position. Furthermore, as the blade carriage 152 is being retracted toward the rear of the utility knife 100 to retract cutting blade 101, the linear gear 166 on the blade carriage extension arm 164 causes rotation of a pinion gear 150, which is in turn transferred to the linear gear 140 formed on the slider rack, thereby causing the slider rack to move toward the front of the utility knife independently of the slider button. When the slider button is released, a separate tension component 177 attached to the front of the slider button extension arm 129 causes the slider button to return to the retracted position in the forward portion of the slider button channel. As the slider button returns to the retracted position, the ribbing 146 on the slider pin and the slider pin grooves 112 in the housing shell 107 cause the slider pin to move back to its starting position within the slider pin recess 130 and to reengage with the lever arm 137 of the slider rack.

Figure 5A:
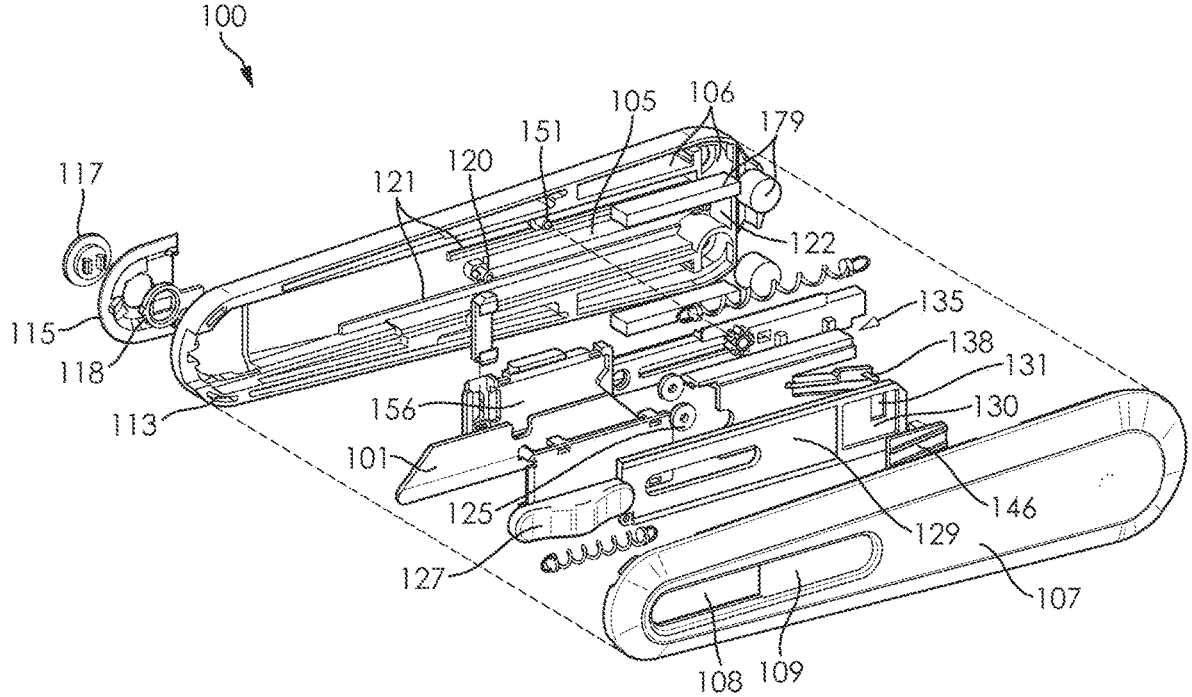
FIGS. 5A and 5B are front and rear exploded perspective views of a utility knife in accordance with a first embodiment of the present invention.
Figure 5B:
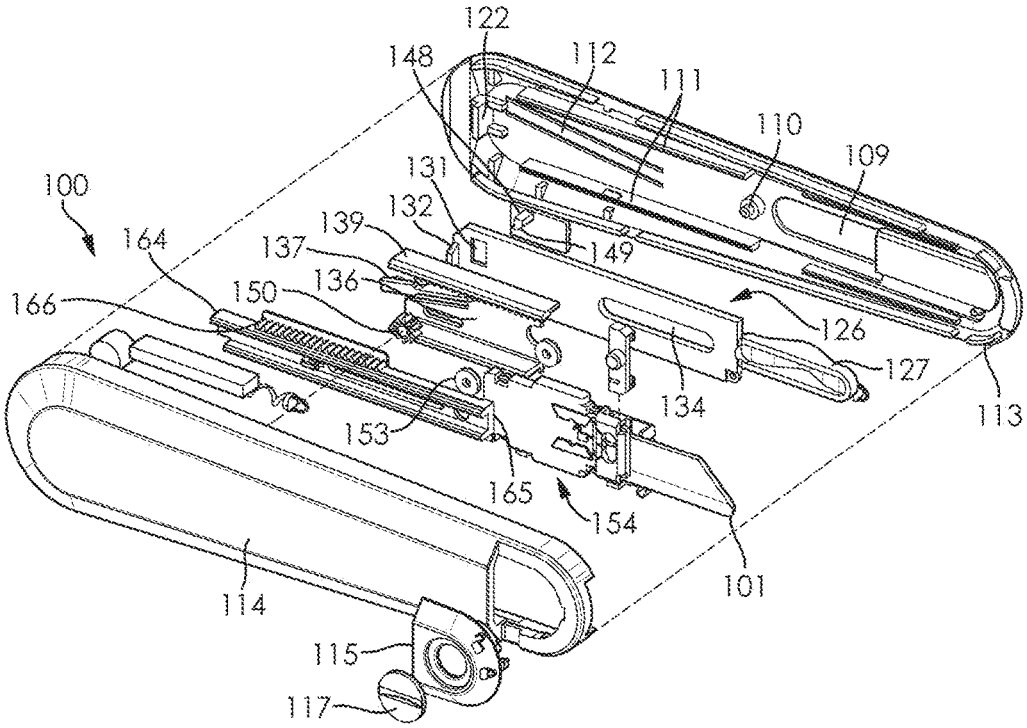

Turning now to FIGS. 5A and 5B, front and rear exploded perspective views of a utility knife with a rack-and-pinion blade actuation mechanism, in accordance with an embodiment of present invention. In a preferred embodiment, the utility knife 100 primarily comprises a housing shell and a blade actuation mechanism. In the preferred embodiment, the housing shell comprises a front-half 107 and rear-half 114 that are configured to retain the blade actuation mechanism. The slider button channel 108 and slider button opening 109 are formed on the exterior surface of the front-half housing shell 107. The interior surface of the front-half housing shell 107 includes the slider button post 110, the slider button track 111, the slider pin grooves 112, the front housing engagement means 113, and the rear housing engagement means 122. A blade access panel 115 on the rear-half housing shell 114, provides access to the cutting blade 101. The blade access panel 115 primarily comprises an access panel lock formed from an outer slotted disk 117 and an inner latching component 118. The interior surface of the rear-half housing shell 114 includes a groove 105 for the tension component, recesses 106 for the weights 179, the front housing engagement means 113, the blade carriage post 120, the blade carriage track 121, the rear housing engagement means 122, and pinion gear post 151. In the preferred embodiment, the blade actuation mechanism primarily comprises a slider button assembly, a blade carriage assembly, and a pinion gear 150. The slider button assembly comprises the slider button washer 125, the slider button 126, the slider rack 135, and the slider pin 146. The slider button 126 comprises the button knob 127 and the slider button extension arm 129, which is formed with the slider pin recess 130, a slider rack engagement flange 132, and the slider post slot 134. The slider rack 135 comprises a main body portion 136 formed with a lever arm 137 with a catch portion 138, and an upper lip 139 with a linear gear. The catch portion 138 of the lever arm 137 engages with hooked portion 149 of the rack lever latching post 148. The slider pin 146 comprises a ribbed front plate portion and a rack lever latching post 148 with a hooked portion 149. The rack lever latching post 148 passes through a hole 131 in the slider button recess 130 of the slider button extension arm 129 and engages with the lever arm 137 of the slider rack 135. The blade carriage assembly comprises the blade carriage washer 153, the blade carriage 154, the blade holder cover, and the blade retention pin. The blade carriage 154 comprises the blade holder and the blade carriage extension arm 164. The blade holder is formed with a depression 156 configured to retain the cutting blade 101. The blade carriage extension arm 164 has an offset 165 from the blade holder and is formed with a linear gear 166.

Figure 6:
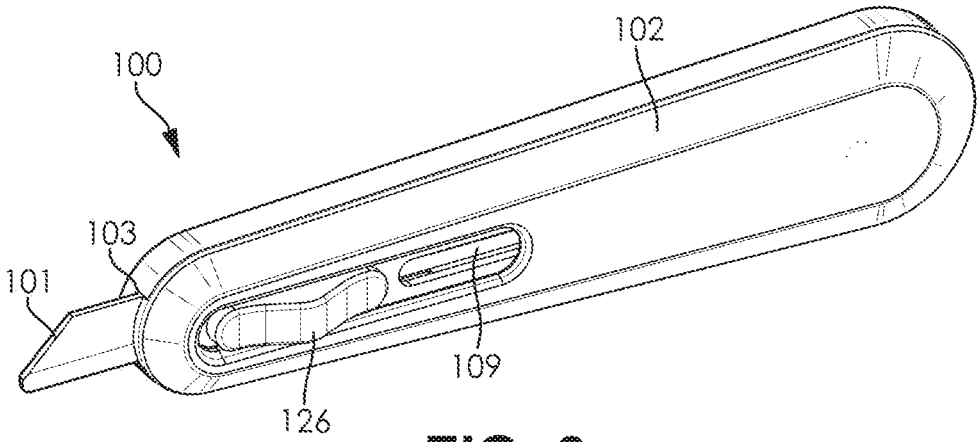
FIG. 6 is a front perspective view of a utility knife in accordance with a second embodiment of the present invention.

Turning now to FIG. 6, a front perspective view of an automatically retractable utility knife with a direct connection between the slider button assembly and the blade carriage assembly, in accordance with an embodiment of present invention. In some embodiments, the utility knife 100 primarily comprises a housing shell 102 configured to internally retain a blade actuation mechanism. In some embodiments, the blade actuation mechanism features a slider button assembly and blade carriage assembly that are directly connected. The direct connection between the slider button assembly and the blade carriage assembly enables a user to extend the cutting blade 101 through the blade outlet slot 103 at the front edge of the utility knife 100 by sliding the slider button 126 of the slider button assembly towards the front of the slider button channel 108 formed at the front portion of the utility knife 100.

Figure 7A:
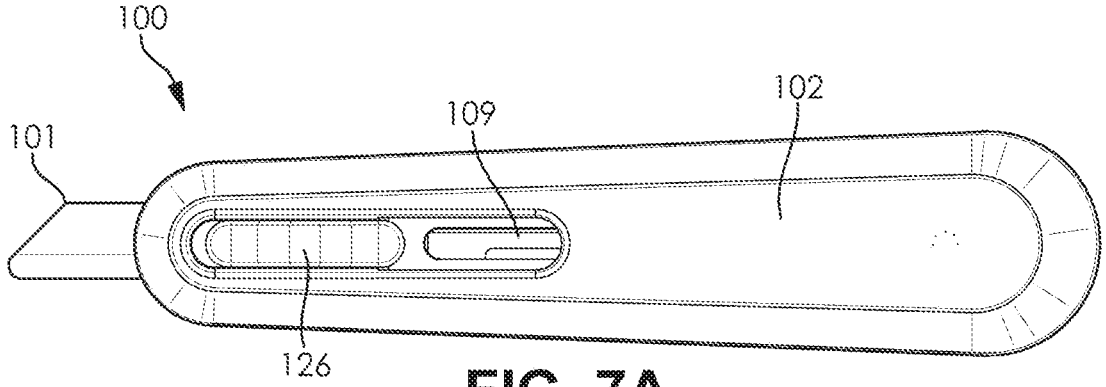
FIGS. 7A and 7B are front views of a utility knife in accordance with a second embodiment of the present invention.
Figure 7B:
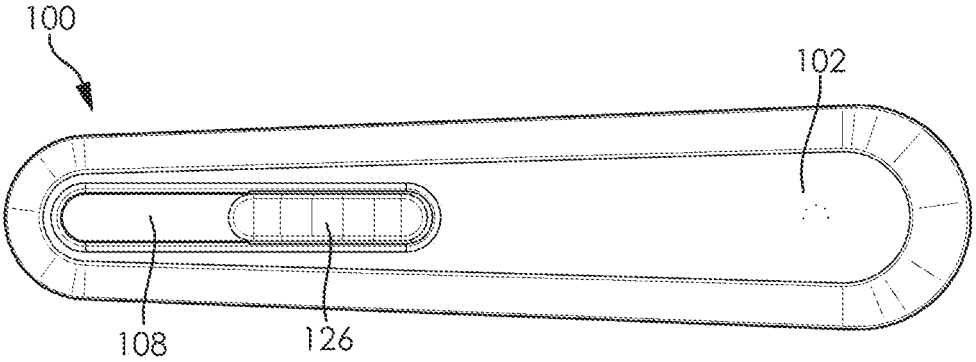

Turning now to FIGS. 7A and 7B, front views of an automatically retractable utility knife with a direct connection between the slider button assembly and the blade carriage assembly, in accordance with an embodiment of present invention. As shown in FIG. 7A, the direct connection between the slider button assembly and the blade carriage assembly enables a user to extend the cutting blade 101 by sliding the slider button 126 of the slider button assembly towards the front of the slider button channel 108 that is formed in the front of the housing shell 102. As shown in FIG. 7B, the cutting blade is retracted when the slider button 126 is in the rearward position. Additionally, FIG. 7A, illustrates that the slider button 126 of the slider button assembly passes through a slider button opening 109 that is formed in the slider button channel 108.

Figure 8A:
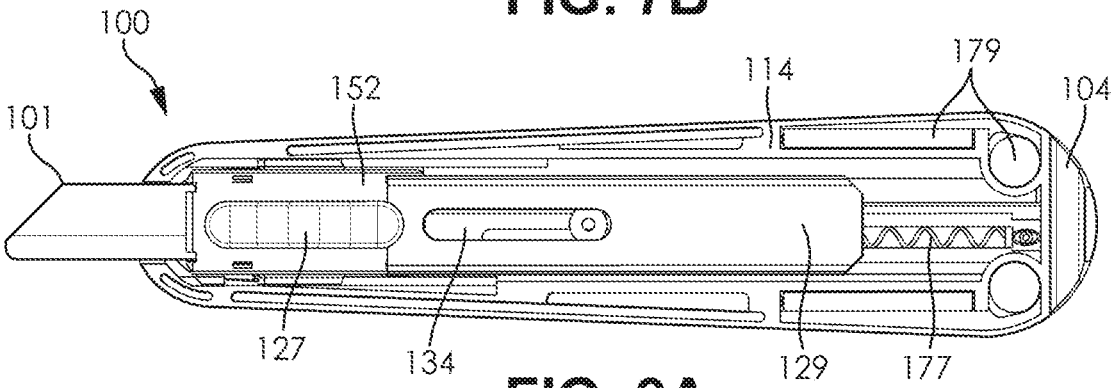
FIGS. 8A and 8B are front and rear internal views of a utility knife with the cutting blade in an extended position in accordance with a second embodiment of the present invention.
Figure 8B:
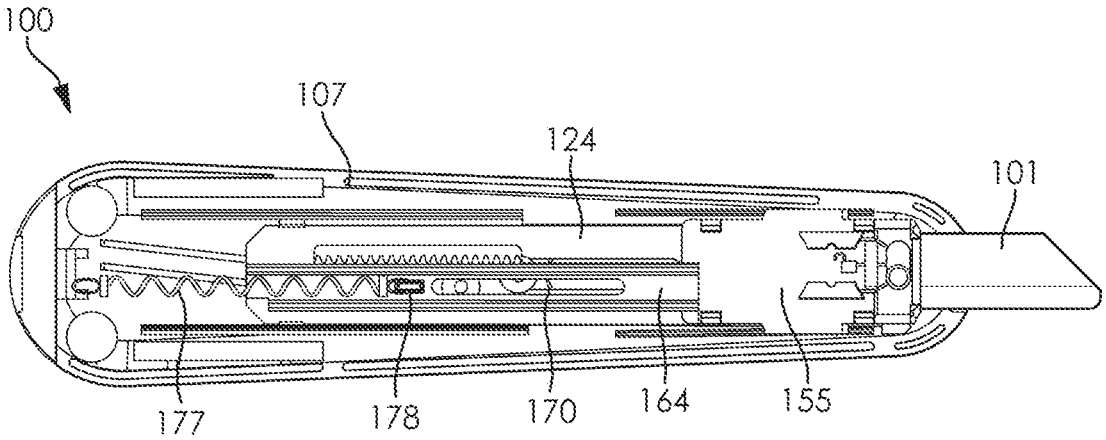

Turning now to FIGS. 8A and 8B, front and rear internal views of an automatically retractable utility knife with a direct connection between the slider button assembly and the blade carriage assembly and a cutting blade in the extended position, in accordance with an embodiment of present invention. In some embodiments, the cutting blade 101 is extended when the slider button assembly 124 and the blade carriage assembly 152 are moved forward. In particular, as the slider button assembly 124 is moved toward the front of the utility knife 101, the blade carriage assembly 152 is also moved forward because of the direction connection between those two components. When the button knob 127 is moved forward, a connection between the slider button extension arm 129 and the blade carriage extension arm 164 causes the cutting blade 101 in the blade holder 155 to be extended. Additionally, the forward movement of the blade carriage assembly 152 causes the tension component 177 to be stretched so that the cutting blade 101 can be automatically retracted when the button knob 127 is released.

Figure 9A:
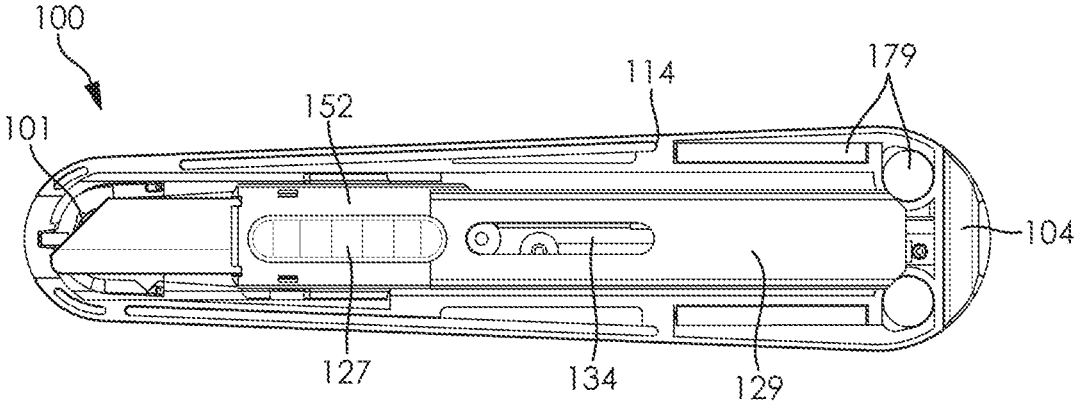
FIGS. 9A and 9B are front and rear internal views of a utility knife with the cutting blade in retracted position in accordance with a second embodiment of the present invention.
Figure 9B:
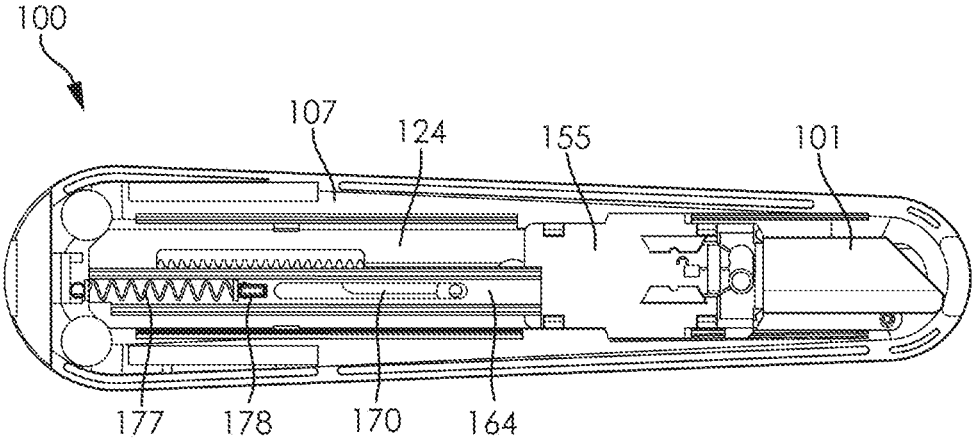

Turning now to FIGS. 9A and 9B, front and rear internal views of an automatically retractable utility knife with a direct connection between the slider button assembly and the blade carriage assembly and a cutting blade in the retracted position, in accordance with an embodiment of present invention. In some embodiments, the cutting blade 101 is retracted when the slider button assembly 124 and the blade carriage assembly 152 are positioned toward the rear of the utility knife 101. In particular, tension from the tension component 177 biases the blade carriage assembly 152, and therefore the slider button assembly 124, toward the rear of the utility knife 100. When the button knob 127 is released, the tension component causes the blade carriage assembly 152 to move rearward and the cutting blade 101 to be retracted. Furthermore, the connection between the slider button extension arm 129 and the blade carriage extension arm 164 causes the slider button assembly 124 to move back to the retracted position as the tension component 177 simultaneously retracts the blade carriage assembly 152.

Figure 10A:
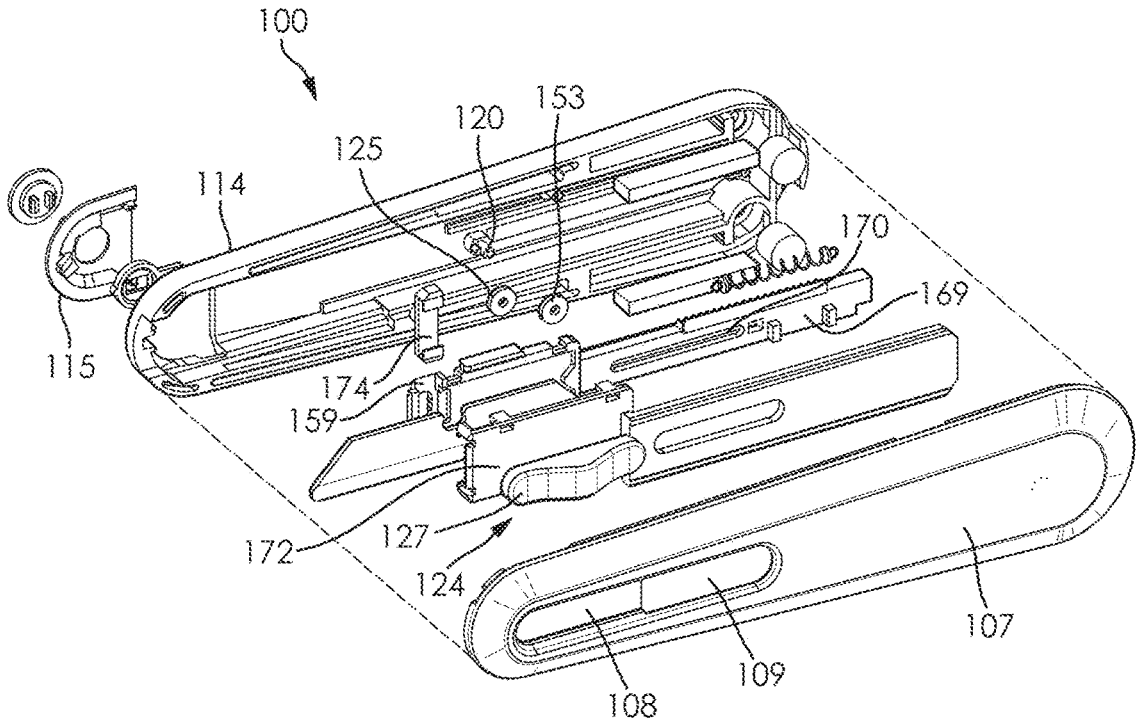
FIGS. 10A and 10B are front and rear exploded perspective views of a utility knife in accordance with a second embodiment of the present invention.
Figure 10B:
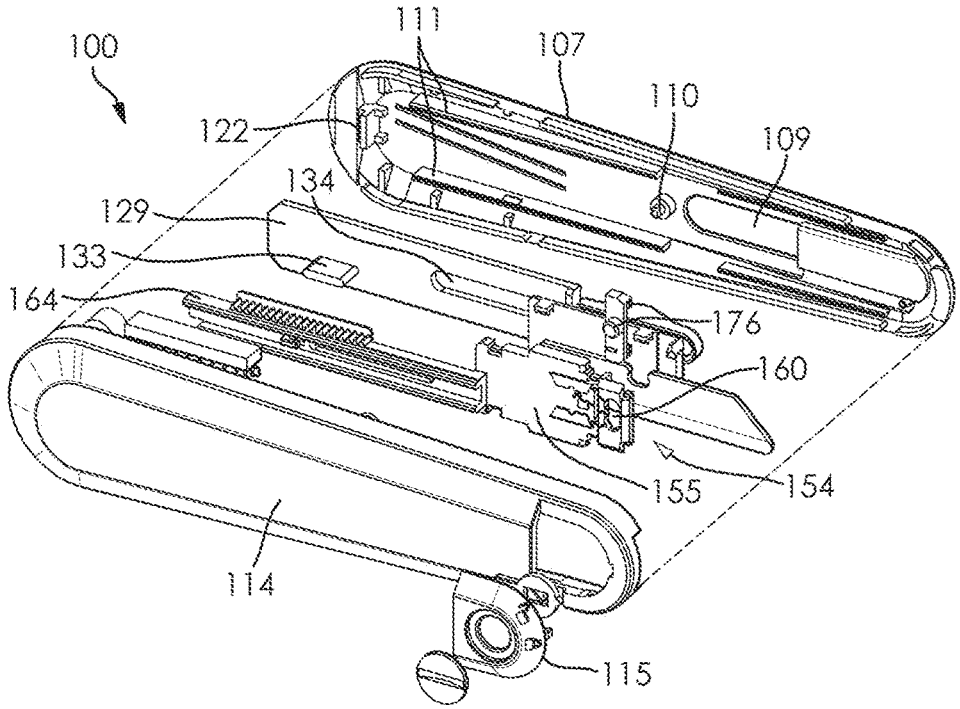

Turning now to FIGS. 10A and 10B, front and rear exploded perspective views of an automatically retractable utility knife with a direct connection between the slider button assembly and the blade carriage assembly, in accordance with an embodiment of present invention. In some embodiments, the utility knife 100 primarily comprises a housing shell and a blade actuation mechanism. In some embodiments, the housing shell comprises a front-half 107 and rear-half 114 that are configured to retain the blade actuation mechanism. The slider button channel 108 and slider button opening 109 are formed on the exterior surface of the front-half housing shell 107. The interior surface of the front-half housing shell 107 also includes the slider button post 110, the slider button track 111, the front housing engagement means 113, and the rear housing engagement means 122. A blade access panel 115 on the rear-half housing shell 114, provides access to the cutting blade 101. The interior surface of the rear-half housing shell 114 includes the blade carriage post 120. In some embodiments, the blade actuation mechanism primarily comprises a slider button assembly 124 and a blade carriage assembly. The slider button assembly comprises 124 the slider button washer 125 and the slider button. The slider button comprises the button knob 127 and the slider button extension arm 129, which is formed with the carriage engagement post 133 and the slider post slot 134. The carriage engagement post 133 is adapted to engage with the flanges 169 formed on the blade carriage extension arm 164. The slider post slot 134 allows the slider button post 110 to pass through the extension arm 129 of the slider button extension arm 129. By passing through the slider button, the slider button post 110 can guide and limit the movement of the slider button, while also providing an attachment point for the slider button washer 125. The blade carriage assembly comprises the blade carriage washer 153, the blade carriage 154, the blade holder cover 172, and the blade retention pin 174. The blade carriage 154 comprises the blade holder 155 and the blade carriage extension arm 164. The blade holder 155 is formed with a retention pin channel 159 that is adapted to receive the blade retention pin 174. The retention pin channel 159 also includes a lock slot 160 that receives a post 176 formed on the rear of the blade retention pin 174. The blade carriage extension arm 164 is formed with a carriage post slot 170, which allows the blade carriage post 120 to pass through the blade carriage extension arm 164. By passing through the blade carriage extension arm 164, the blade carriage post 120 can guide and limit the movement of the blade carriage 154, while also providing an attachment point for the blade carriage washer 153.

Figure 11:
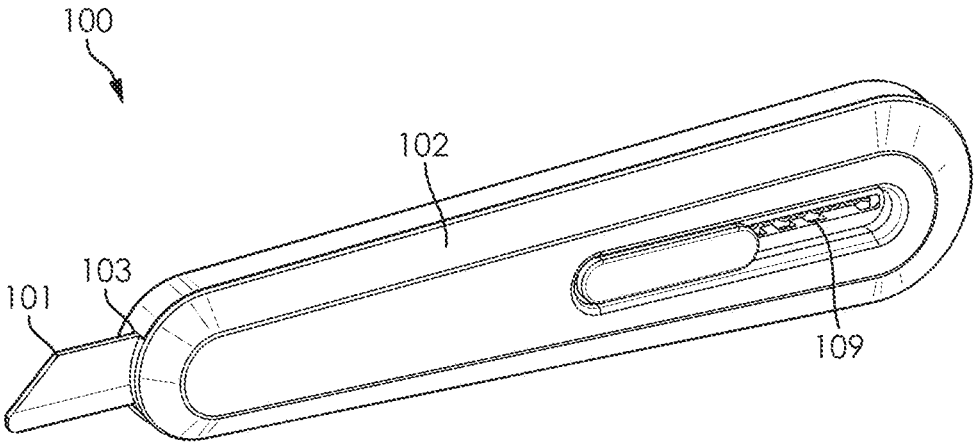
FIG. 11 is a front perspective view of a utility knife in accordance with a third embodiment of the present invention.

Turning now to FIG. 11, a front perspective view of a manually retractable utility knife with a direct connection between the slider button assembly and the blade carriage assembly, in accordance with an embodiment of present invention. In some embodiments, the utility knife 100 primarily comprises a housing shell 102 configured to internally retain a blade actuation mechanism. In some embodiments, the blade actuation mechanism features a slider button assembly and blade carriage assembly that are directly connected. The direct connection between the slider button assembly and the blade carriage assembly enables a user to extend the cutting blade 101 through the blade outlet slot 103 at the front edge of the utility knife 100 by sliding the slider button 126 of the slider button assembly towards the front of the slider button channel 108 formed at the rear portion of the utility knife 100.

Figure 12A:
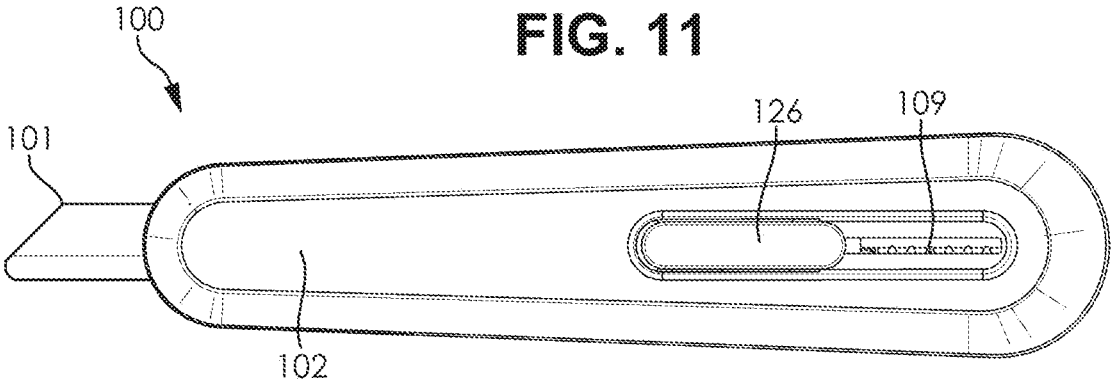
FIGS. 12A and 12B are front views of a utility knife in accordance with a third embodiment of the present invention.
Figure 12B:
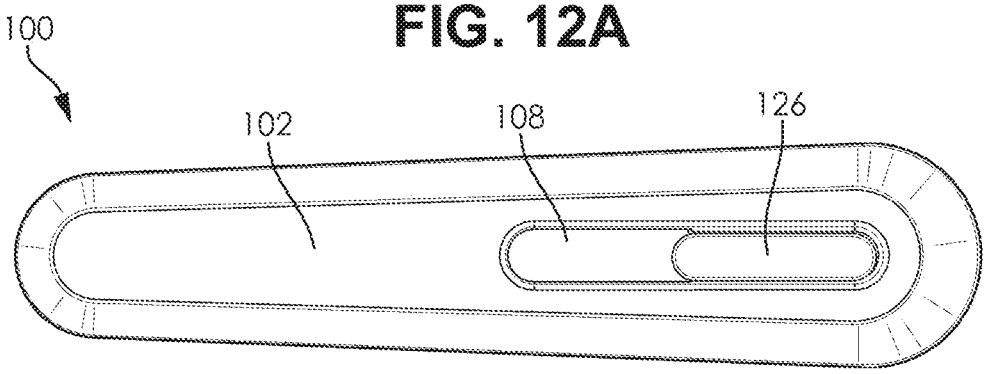

Turning now to FIGS. 12A and 12B, front views of an manually retractable utility knife with a direct connection between the slider button assembly and the blade carriage assembly, in accordance with an embodiment of present invention. As shown in FIG. 12A, the direct connection between the slider button assembly and the blade carriage assembly enables a user to extend the cutting blade 101 by sliding the slider button 126 of the slider button assembly towards the front of the slider button channel 108 that is formed at the rear of the housing shell 102. As shown in FIG. 12B, the cutting blade is retracted when the slider button 126 is in the rearward position. Additionally, FIG. 12A, illustrates that the slider button 126 of the slider button assembly passes through a slider button opening 109 that is formed in the slider button channel 108.

Figure 13A:
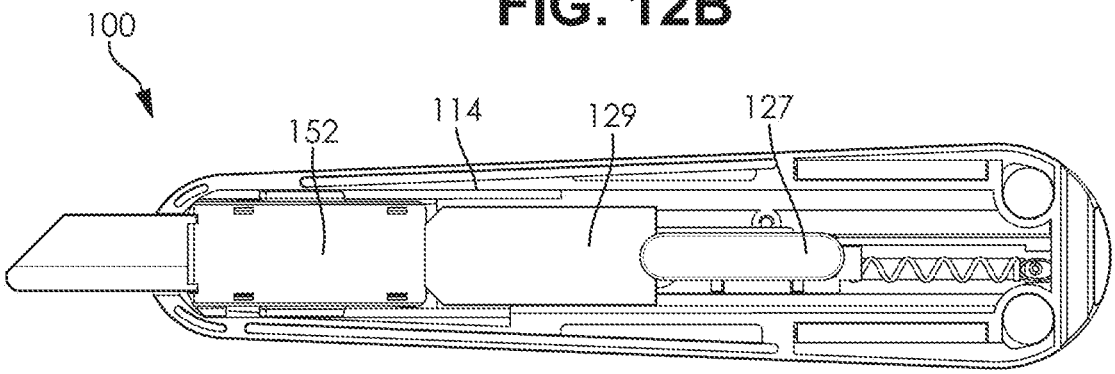
FIGS. 13A and 13B are front and rear internal views of a utility knife with the cutting blade in an extended position in accordance with a third embodiment of the present invention.
Figure 13B:
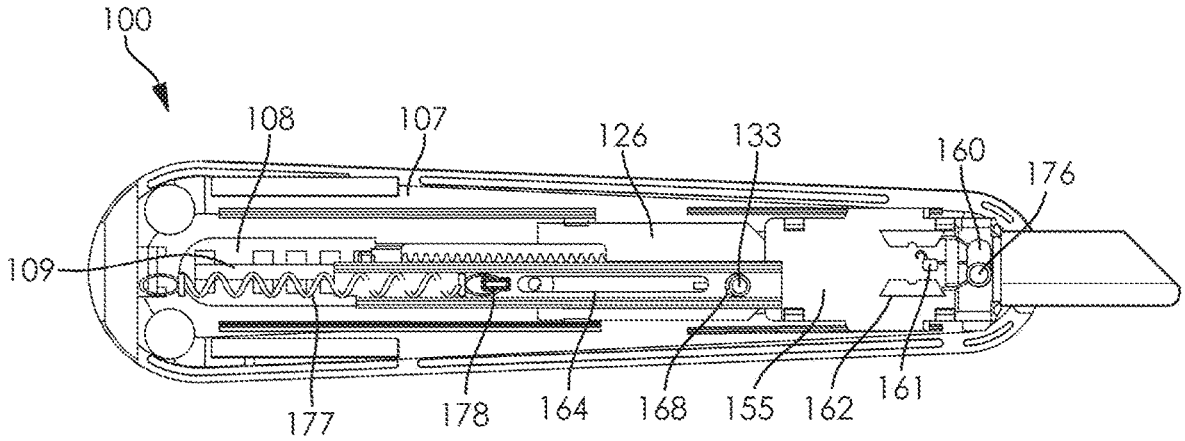

Turning now to FIGS. 13A and 13B, front and rear internal views of a manually retractable utility knife with a direct connection between the slider button assembly and the blade carriage assembly and a cutting blade in the extended position, in accordance with an embodiment of present invention. In some embodiments, the cutting blade is extended when the slider button and the blade carriage assembly 152 is moved toward the front of the utility knife 100. In particular, as the slider button is moved toward the front of the utility knife 101, the blade carriage assembly 152 is also moved forward because of the direct connection between those two components. The direct connection between the blade carriage assembly 152 and the slider button 126 is a connection between the carriage engagement post 133 on the rear of slider button 126 and a hole 168 on the blade carriage extension arm 164 causes the cutting blade in the blade holder 155 to be extended. When in the extended position, the button lock lever (not shown) engages with locking points formed on the inner surface of the slider button channel 108. In some embodiments, the blade holder 155 of the blade carriage includes a retention pin lock indicator 161 and a blade orientation indicator 162. The blade orientation indictor 162 shows which way the post 176 on the rear of the retention pin should be moved within the lock slot 160 so that the retention pin securely locks the cutting blade in place within the blade holder 155 based on the orientation of the cutting blade. When the post 176 on the rear of the retention pin is in the middle of the lock slot 160, which is indicated by the unlocked lock symbol of the retention pin lock indicator 161, the cutting blade can be removed from the blade holder 155.

Figure 14A:
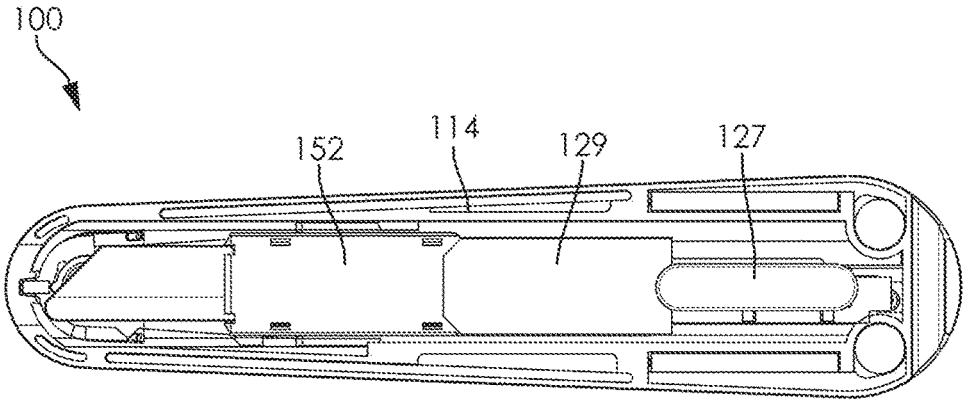
FIGS. 14A and 14B are front and rear internal views of a utility knife with the cutting blade in retracted position in accordance with a third embodiment of the present invention.
Figure 14B:
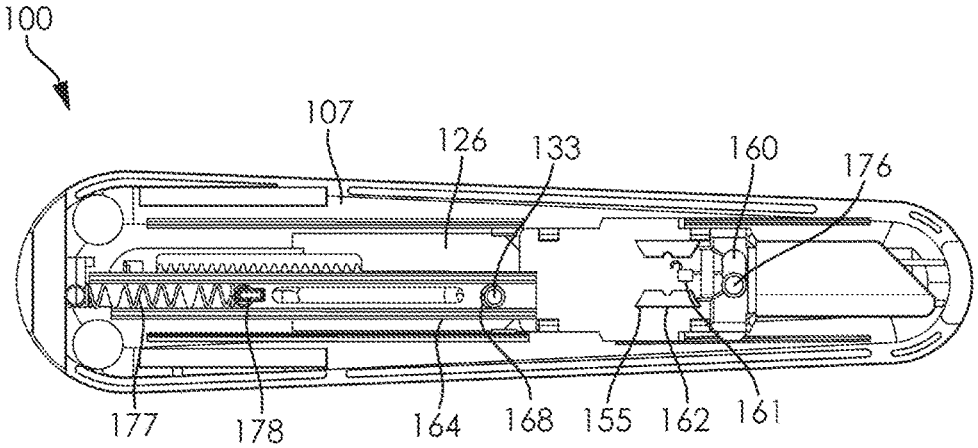

Turning now to FIGS. 14A and 14B, front and rear internal views of a manually retractable utility knife with a direct connection between the slider button assembly and the blade carriage assembly and a cutting blade in the retracted position, in accordance with an embodiment of present invention. In some embodiments, the cutting blade is retracted when the slider button 126 and the blade carriage assembly 152 is moved toward the rear of the utility knife 100. In particular, as the button knob 127 and slider button extension arm 128 of the slider button 126 is moved toward the rear of the utility knife 101, the blade carriage assembly 152 is also moved rearward because of the direct connection between those two components. The direct connection between the blade carriage assembly 152 and the slider button 126 is a connection between the carriage engagement post 133 on the rear of slider button 126 and a hole 168 on the blade carriage extension arm 164 that causes the cutting blade in the blade holder 155 to be retracted. When in the extended position, the button lock lever (not shown) engages with locking points formed on the inner surface of the slider button channel 108.

Figure 15A:
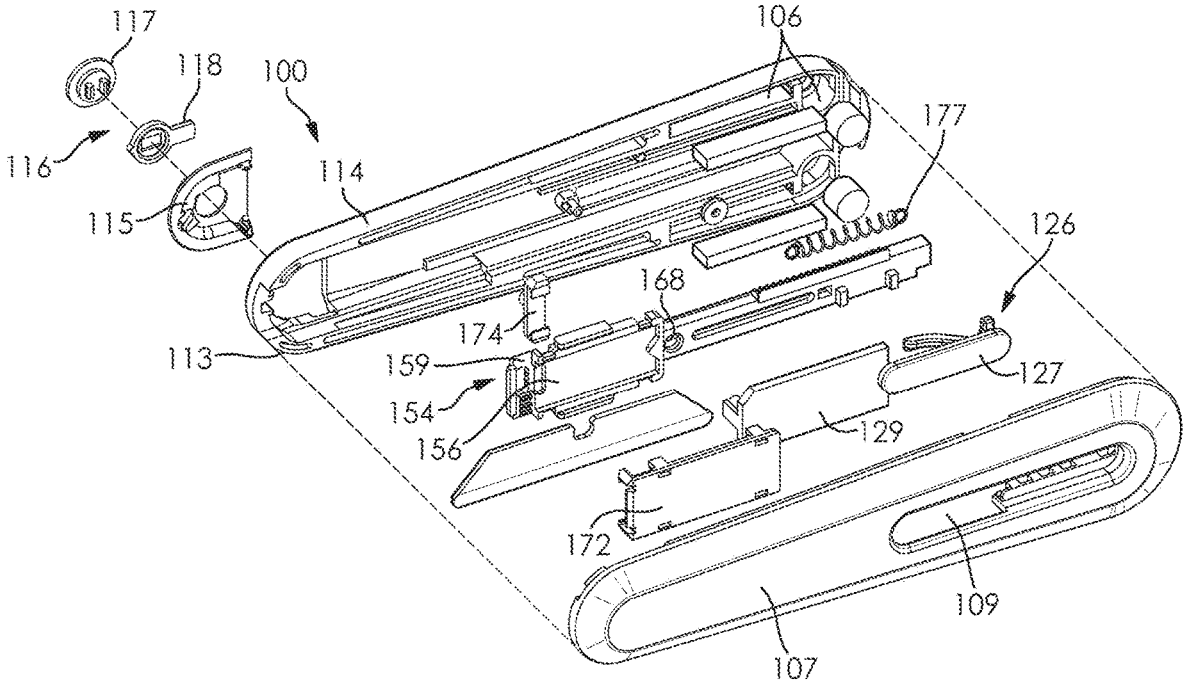
FIGS. 15A and 15B are front and rear exploded perspective views of a utility knife in accordance with a third embodiment of the present invention.
Figure 15B:
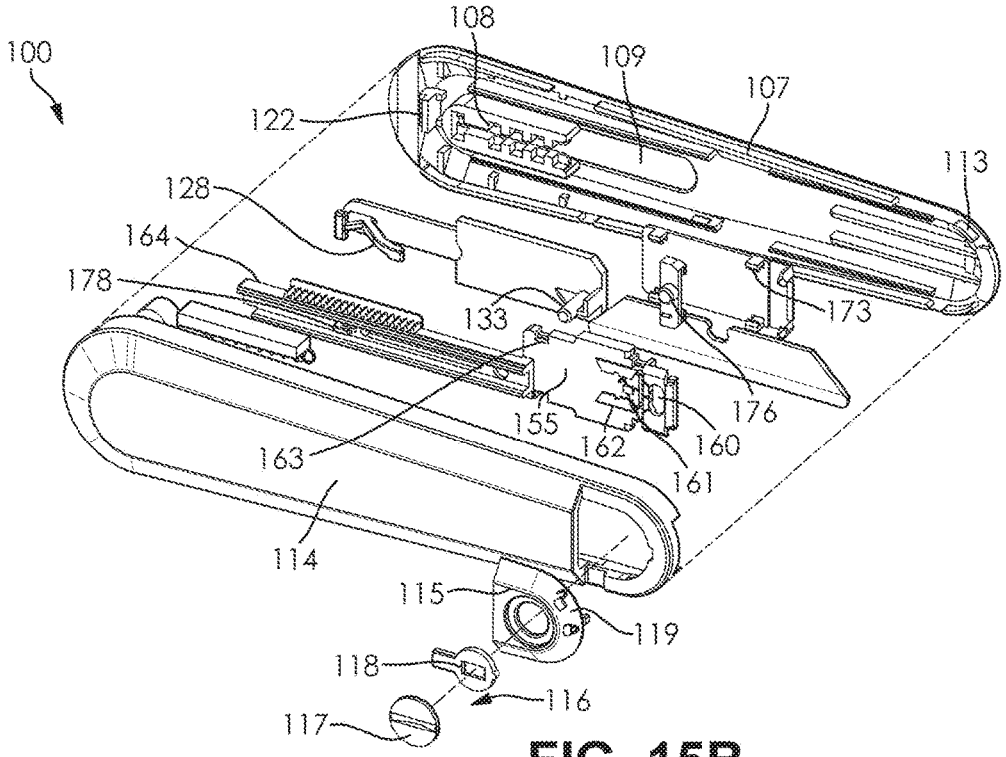

Turning now to FIGS. 15A and 15B, front and rear exploded perspective views of a manually retractable utility knife with a direct connection between the slider button assembly and the blade carriage assembly, in accordance with an embodiment of present invention. In some embodiments, the utility knife 100 primarily comprises a housing shell and a blade actuation mechanism. In some embodiments, the housing shell comprises a front-half 107 and rear-half 114 that are configured to retain the blade actuation mechanism. The slider button channel 108 is a depression formed in the front-half housing shell 107, with a slider button opening 109 formed through the front-half housing shell. The interior surface of the front-half housing shell 107 also includes a series of locking points formed on the inner surface of the slider button channel 108, and the front housing engagement means 113, and the rear housing engagement means 122. A blade access panel 115 on the rear-half housing shell 114, provides access to the cutting blade. The blade access panel 115 primarily comprises an access panel lock 116 formed from an outer slotted disk 117 and an inner latching component 118. The blade access panel may also include an access panel lock indicator 119. The interior surface of the rear-half housing shell 114 includes the recesses 106 configured to retain the weights and the front housing engagement means 113. In some embodiments, the blade actuation mechanism primarily comprises a slider button 126 and a blade carriage assembly. The slider button 126 comprises the button knob 127 and the slider button extension arm 129. A button lock lever 128 is formed on the rear of the button knob 127 and is configured to pass through the slider button opening 109 such that the ends of each arm of the button lock lever 128 are inside of the housing shell. Inside the housing shell, the button lock lever 128 is adapted to both flexibly abut the blade carriage extension arm 164 and to engage with the locking points formed on the inner surface of the blade carriage channel 108. A blade carriage engagement post 133 is formed on the rear of the slider button extension arm 129 and is configured to engage with a hole 168 formed on the blade carriage extension arm 164. The blade carriage assembly comprises the blade carriage 154, the blade holder cover 172, and the blade retention pin 174. The blade carriage primarily comprises a blade holder 155 and a blade carriage extension arm 164. The blade holder 155 comprises a depression 156 formed to receive a cutting blade, a retention pin channel 159, a retention pin lock indicator 161, and the blade orientation indicator 162. The retention pin channel 159 is configured to receive the blade retention pin 174 and is also formed with a lock slot 160 that is adapted to receive post 176 formed on the rear of the blade retention pin 174. The blade holder cover 172 is formed with a plurality of attachment arms 173 that configured to attach the blade holder cover 172 to attachment points 163 on the blade holder 155.

Figure 16:
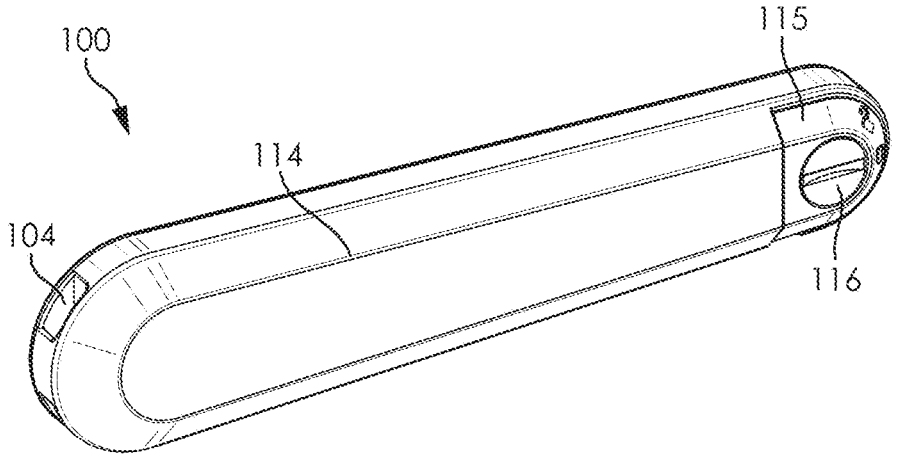
FIG. 16 is a rear perspective view of a utility knife in accordance with the embodiments of the present invention.

Turning now to FIG. 16, a rear perspective view of a utility knife, in accordance with an embodiment of present invention. In a preferred embodiment, the rear-half housing shell 114 of the utility knife 100 includes a lanyard attachment point 104 and a blade access panel 115. In the preferred embodiment, the blade access panel 115 comprises an access panel lock 116 that secures the blade access panel 115 in place on the rear-half housing shell 114.

Figure 17:
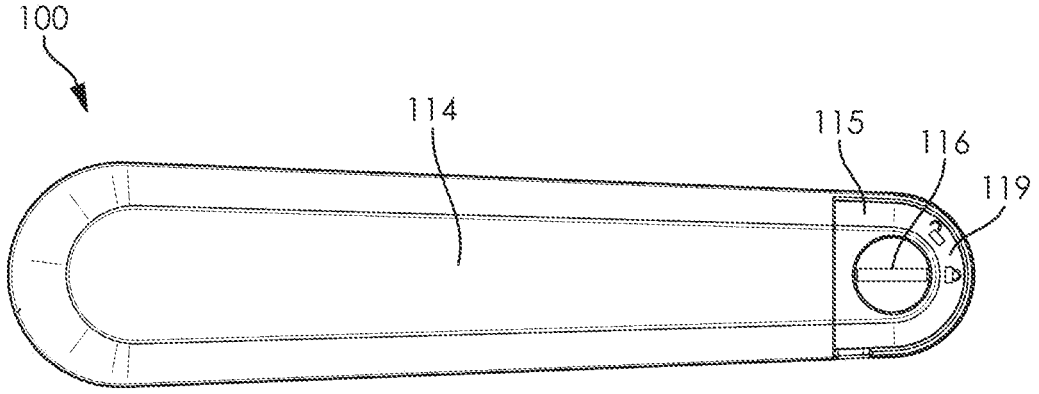
FIG. 17 is a rear view of a utility knife in accordance with the embodiments of the present invention of the present invention.

Turning now to FIG. 17, a rear view of a utility knife, in accordance with an embodiment of present invention. In a preferred embodiment, the rear-half housing shell 114 of the utility knife 100 includes a blade access panel 115. In the preferred embodiment, the blade access panel 115 comprises an access panel lock 116 that secures the blade access panel 115 in place on the rear-half housing shell 114. An access panel lock indicator 119 shows whether the access panel lock 116 is in the locked position.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. An automatically retracting utility knife, comprising:

a blade actuation mechanism comprising a slider button, a slider rack, and a blade carriage configured to retain a cutting blade, wherein said slider button is detachably connected to said slider rack and said slider rack is operably connected to said blade carriage such that when said cutting blade is engaged with a cutting surface, said blade carriage is pulled forward thereby causing said slider rack to move rearward and disconnect from said slider button thereby interrupting an indirect connection between said slider button and said blade carriage and permitting said blade carriage to be automatically retracted by a tension component when said cutting blade is lifted from said cutting surface regardless of where said slider button is positioned.

2. The automatically retracting utility knife of claim 1, wherein said slider rack and blade carriage are operably connected in a rack-and-pinion arrangement via a pinion gear.

3. The automatically retracting utility knife of claim 1, further comprising a pinion gear operably connecting said slider rack to said blade carriage in a rack-and-pinion configuration and a blade outlet formed in said utility knife from which said cutting blade extends, wherein said rack-and-pinion configuration facilitates said slider button being pulled in a direction away from said blade outlet in order to extend said cutting blade through said blade outlet in a direction that is opposite of which said slider button is moved to place said cutting blade in an extended position.

4. An retracting utility knife, comprising:

a blade actuation mechanism comprising:

a blade carriage configured with a first linear gear configured to retain a cutting blade that can be movably extended from a blade outlet formed in said utility knife; and a slider button assembly comprising a slider button extending outside of a housing of the retracting utility knife and a separately formed slider rack configured with a second linear gear, wherein said slider rack is slidablv detachable from said slider button and said slider button is indirectly connected to said blade carriage via a pinion gear and said slider rack, wherein said slider rack and said blade carriage are discrete components that are operably connected in a rack-and-pinion arrangement through the pinion gear that operates between the first linear gear and second linear gear such that pulling said slider button in a direction away from said blade outlet causes said cutting blade to be extended through said blade outlet.

5. The retracting utility knife of claim 4, wherein a tension component attached to said blade actuation mechanism causes said cutting blade to be automatically retracted when said cutting blade is lifted from a cutting surface regardless of whether said slider button has been released from a blade extending position.

6. The retracting utility knife of claim 5, wherein moving said cutting blade across said cutting surface causes said slider button to disengage from said slider rack.

7. The retracting utility knife of claim 4, wherein said slider button is reversibly connected to said slider rack via a slider pin disposed on said slider button.

8. The retracting utility knife of claim 7, wherein said slider pin reversibly connects with a lever arm formed on said slider rack.

9. An automatically retracting utility knife, comprising:

a blade actuation mechanism comprising a slider button assembly with a slider button and a blade carriage assembly configured to retain a cutting blade, wherein said slider button and blade carriage assembly have an indirect detachable connection via a slider rack such that extending and engaging said cutting blade with a cutting surface causes said blade carriage assembly to be pulled forward and said slider button to reversibly disconnect from said slider rack thereby interrupting said indirect detachable connection between said slider button and said blade carriage assembly and permitting a tension component to automatically retract said blade carriage assembly and said cutting blade when said cutting blade is lifted from said cutting surface regardless of whether said slider button has been released from a blade extending position.

10. The automatically retracting utility knife of claim 9, wherein said slider button assembly and said blade carriage assembly are operably connected via a pinion gear that enables a rack-and-pinion movement relationship between said slider button assembly and said blade carriage assembly.

11. The automatically retracting utility knife of claim 10, further comprising a blade outlet formed on a front portion of said automatically retracting utility knife, wherein said blade actuation mechanism is configured such that said slider button is pulled in a direction away from said blade outlet toward a rear portion of said automatically retracting utility knife in order to extend said cutting blade through said blade outlet.

12. The automatically retracting utility knife of claim 9, wherein said slider button is reversibly connected to said slider rack via a slider pin disposed in a recess on said slider button.

13. The automatically retracting utility knife of claim 12, wherein said a portion of said slider pin extends through said recess on said slider button and reversibly connects with a lever arm formed on said slider rack.

* * * * *